US005575474A

United States Patent [19]

Rossides

[11] Patent Number: 5,575,474

[45] Date of Patent: Nov. 19, 1996

[54] COMMUNICATIONS SYSTEM USING BETS

[76] Inventor: Michael Rossides, 3666 Upton St. NW., Washington, D.C. 20008

[21] Appl. No.: 309,677

[22] Filed: Sep. 21, 1994

[51] Int. Cl.[6] ..... A63F 9/24

[52] U.S. Cl. ..... 463/26

[58] Field of Search ..... 273/138 A, 139, 273/269, 143 R, 85 CP

[56] References Cited

U.S. PATENT DOCUMENTS

| | | | |
|---|---|---|---|
| 4,689,742 | 8/1987 | Troy et al. | 364/412 |
| 4,815,741 | 3/1989 | Small | 273/439 X |
| 4,836,553 | 6/1989 | Suttle et al. | 273/292 |
| 4,875,164 | 10/1989 | Monfort | 364/412 |
| 4,922,522 | 5/1990 | Scanlon | 273/138 A X |
| 5,108,115 | 4/1992 | Buman et al. | 273/439 |
| 5,197,094 | 3/1993 | Tillery et al. | 273/439 X |
| 5,226,661 | 7/1993 | Wolf | 273/274 |
| 5,354,069 | 10/1994 | Guttman et al. | 273/439 |
| 5,415,416 | 5/1995 | Scagnelli et al. | 273/439 |

*Primary Examiner*—Jessica J. Harrison
*Assistant Examiner*—Michael O'Neill

[57] ABSTRACT

A computer system that allows people to place, accept and settle bets for the purpose of communicating. The system cuts out the middleman, sometimes referred to as the bookmaker, allowing bettors to bet with each other directly. In addition to allowing people to place, accept and settle bets, the system enables people to settle disputes and change bets. It also allows people to place special types of bets for the purpose of demonstrating probability estimates. The system allows people to to link bets to ordinary statements that are also entered into the system.

2 Claims, 13 Drawing Sheets

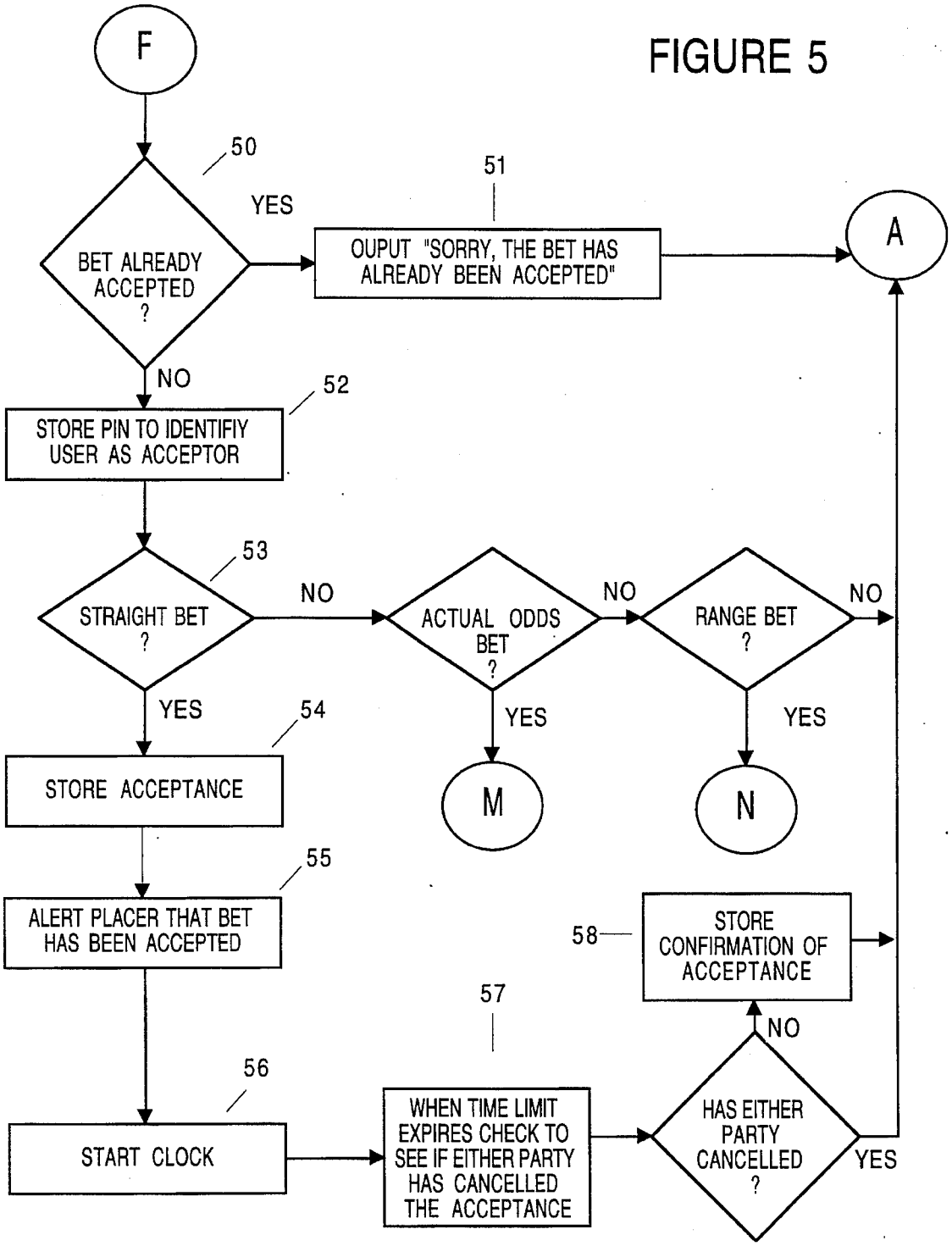
FIGURE 5
F
50
BET ALREADY ACCEPTED ?
YES
51
OUPUT "SORRY, THE BET HAS ALREADY BEEN ACCEPTED"
A
NO
52
STORE PIN TO IDENTIFIY USER AS ACCEPTOR
53
STRAIGHT BET ?
NO
ACTUAL ODDS BET ?
NO
RANGE BET ?
NO
YES
54
STORE ACCEPTANCE
YES
M
YES
N
55
ALERT PLACER THAT BET HAS BEEN ACCEPTED
58
STORE CONFIRMATION OF ACCEPTANCE
57
NO
56
START CLOCK
WHEN TIME LIMIT EXPIRES CHECK TO SEE IF EITHER PARTY HAS CANCELLED THE ACCEPTANCE
HAS EITHER PARTY CANCELLED ?
YES

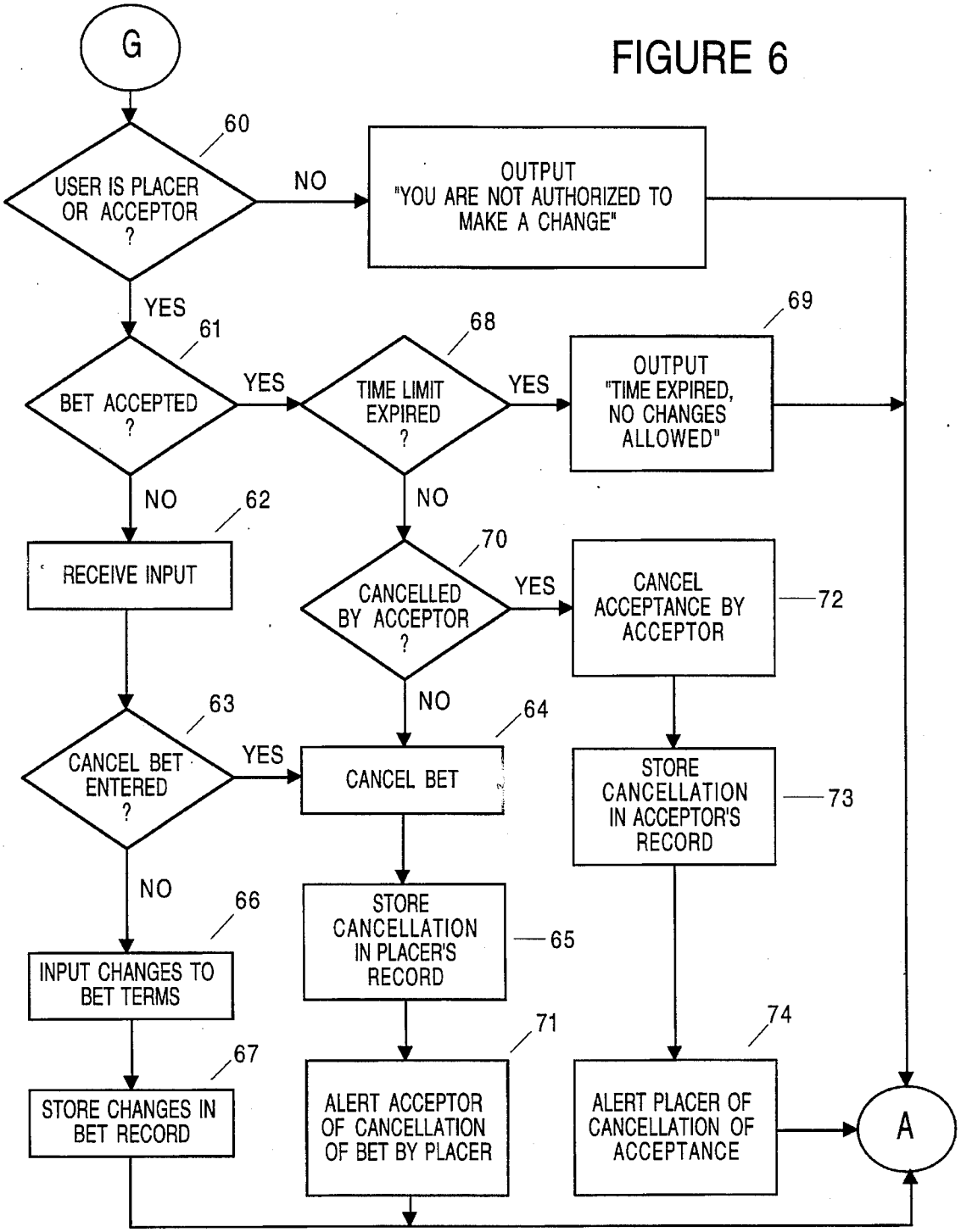
G
FIGURE 6
60
USER IS PLACER OR ACCEPTOR ?
NO
OUTPUT "YOU ARE NOT AUTHORIZED TO MAKE A CHANGE"
YES
61
BET ACCEPTED ?
YES
68
TIME LIMIT EXPIRED ?
YES
69
OUTPUT "TIME EXPIRED, NO CHANGES ALLOWED"
NO
62
RECEIVE INPUT
NO
70
CANCELLED BY ACCEPTOR ?
YES
CANCEL ACCEPTANCE BY ACCEPTOR
72
63
CANCEL BET ENTERED ?
YES
NO
64
CANCEL BET
STORE CANCELLATION IN ACCEPTOR'S RECORD
73
NO
66
INPUT CHANGES TO BET TERMS
STORE CANCELLATION IN PLACER'S RECORD
65
67
STORE CHANGES IN BET RECORD
71
ALERT ACCEPTOR OF CANCELLATION OF BET BY PLACER
74
ALERT PLACER OF CANCELLATION OF ACCEPTANCE
A

COMMUNICATIONS SYSTEM USING BETS

FIELD OF THE INVENTION

This invention relates to a system for storing, displaying, modifying and executing bet backed statements.

BACKGROUND

Betting has been around for thousands of years and computer systems that enable betting have been around for decades. However, people have not appreciated the use of bets for the purpose of communicating. Previous computer systems for handling bets have not allowed the efficient use of bets as communications tools.

The invention disclosed is therefore novel. It is a computer system that enables the easy use of bets for the purpose of communicating. For example, it cuts out the "house" and allows people to bet directly with each other. But, here is not the place to summarize the invention. The main point is that it approaches bets differently than they have been in the past. The essay below explains the point of view that the invention exploits. After the introductory essay (which will eventually be seen in a similar form in a publication called Bet Press), we will go into the description.

Major Invention Unappreciated

Most people think of betting as either a form of entertainment or as a vice, something mostly associated with games like football, cards and dice. Nothing especially important, except in that it might pose a threat to some people. History has shown though that there is a lot more to betting on games than meets the eye. It was the study of a dice game bet that led to the discovery of mathematical probability, a branch of math that has become a central part of science, technology and the way we look at the world.

It is remarkable that a science which began with the consideration of games of chance should have become the most important object of human knowledge.

Pierre Simon de LaPlace, Theorie Analytique des Probabilites

Amazingly, though gambling had been practiced for around 4,000 years, probability was overlooked mathematically until 1654. It was then that a French diceplayer and man-of-the-court, Antoine Gombauld, the Chevalier de Mere, asked Blaise Pascal what the proper bet was in a popular game of dice. Pascal examined Gombauld's question and wrote Pierre de Fermat about it. In a series of letters, Pascal and Fermat analyzed this question and related ones, and in so doing laid the foundations of the mathematics of probability. (About a hundred years before, Girolamo Cardano covered some of the same ground but his work, Book of Dice Games, was not published until 1663.)

Thus the analysis of dice bets revealed general principles of uncertainty—the laws of probability—that apply to much of our thinking about the real world. How could so much be found in such a trivial pursuit as betting on dice? Well, what applies to "trivial" examples can sometimes apply to a very broad range of things. For example, the law of gravity that applied to Newton's apple also applies to the moon and to all matter, as far as we know. In a similar way, what applies to thinking about dice bets also applies to thinking about a very broad range of things. And consequently, the laws mathematical probability have been developed into an extremely useful set of tools. They have been used to construct many disciplines: statistics, risk analysis, and information theory, to name a few.

Betting itself however was left to the gamblers, essentially unused. Though the math of it was worked out in detail, the activity was still considered a vice, dangerous enough to be outlawed for the most part. And that is ironic, for there was still a lot more to this vice than met the eye.

How so? Well, vice type bets share with all bets the same basic set of rules. These rules create a general contest, the bet, that tests the accuracy of people's thinking about uncertainty. More precisely, the bet tests the accuracy of people's probability estimates. The contest can be used to test estimates concerning dice games, card games, horse races and other "trivial" pursuits. But it can also test the accuracy of probability estimates concerning a very broad range of subjects. Indeed, the bet, like the laws of probability, can be used in many fields.

The Rules of the Bet

No one has ever given a crisp definition of the term "bet" and no one will. It is a word that has come to cover so many activities that we can no longer restrict it to certain well defined situations that everyone agrees upon. In this application, we will define a bet as what people think of usually, while realizing that this definition will not cover all possible types of bets. In a this application a bet is an agreement between two people who agree on:

a. A bet statement that can be found true or false.

b. A probability statement (ratio), called the pay-off odds, that tells the proportions of how much the person betting on True has to risk compared to how much the person betting on False has to risk.

c. The amounts of money (or other commodity) each party has at risk.

d. The sides of the bet that each party picks, such that if the bet statement is true, the person who picked True wins and vice versa if the statement is false.

A Fundamental Form of Expression

This agreement is a form of expression. That can be seen in the rules above where the whole point is to make probability statements and then back them up with money. It can also be seen in the well known phrase, "Put your money where your mouth is," which in the case of a bet means something along the lines of, "If you really believe what you're saying, you will take the chance of losing money if you are wrong in exchange for the chance of making money if you are fight."

In fact, the bet is a unique and fundamental form of expression in which people express probability estimates. What makes this type of speech special is that certain kinds of faking are forbidden and others are penalized. In a bet, a person cannot fake knowledge with vagueness, for vagueness is not allowed. And in a bet, a person believes he will be penalized, on average, for giving an overly optimistic estimate of his chance of winning. And in a bet where he sets the odds but lets the other person pick the side, he believes he cannot give and overly optimistic or pessimistic estimate of either side winning, just his best estimate. Here is not the place to go into details but an example will demonstrate. Assume UCLA and Kentucky are two college basketball teams that most bettors agree are evenly matched. And assume that some Senator is a big fan of his old college team, UCLA. And finally, assume he says, "UCLA is ten times better than Kentucky. We're going to blow Kentucky out this Sunday."

And so a skeptical constituent says, "You wanna bet, Mr. Senator?. Please lay some odds on Sunday's game." Notice that vague statements such as "ten times better" and "blow out" are forbidden in a bet. They become a statement that can be found true or false, ("UCLA will beat Kentucky this Sunday") along with a probability statement as to whether the statement is true.

We presume that the Senator in reality thinks that the teams are evenly matched and further that he does not want to lose money. If he sets odds of UCLA above 50%, he believes that he will lose money, on average. Therefore, the bet forces him to set the odds at 50% (or less). In other words, the bet forces him to admit that UCLA is no better than Kentucky.

What if he tries to be falsely pessimistic for the sake of money and claim that UCLA is worse than Kentucky? In this case, he would set the odds of UCLA winning at less than 50% and he would want to bet on UCLA. He would be getting the odds of an underdog even though the teams would be evenly matched. Well in this case the constituent can say, "You set the odds, Mr. Senator, but I'll pick the side." Now the Senator is stuck. If he unreasonably favors either team, the constituent will pick the profitable side.

The moral of the story is that a person who wants to win money in a bet cannot make a falsely optimistic probability statement that the side he is betting on will win. And if he lets the other person pick the side of the bet, he cannot be falsely optimistic about either side winning; the odds must be his best estimate of the chances each side has of winning.

Contest for Pitting Estimates

The bet is more than a contest that penalizes overly optimistic probability statements though, it is the general contest that allows two people to pit their probability estimates in a fair way. In a bet, the estimates are usually not out in the open but are indicated by the side of the bet that each person chooses. The person who has the better estimate will, on average, win money (or whatever is being risked in the bet). Therefore, a person engaging in a bet cannot fake that he knows more than his opponent about the statement being bet on.

This contest would be just an interesting game except that good probability estimates are a fundamental, though usually hidden, part of useful knowledge. By extension they are a fundamental part of reliable communication and good decision making as well. Because the bet can make people more honest about probability estimates, and because, over the long run, it gives a concrete measure of the accuracy of people's estimates, it is far more than an entertainment device; it is a profound invention.

A New Communications Medium

For people to be able to engage in this contest most efficiently, a new medium is needed. Executing bets requires more than just putting them in print. The full execution involves storing statements, setting terms, committing money, getting acceptance of the terms, deciding whether the statements are true, transferring money, settling disputes if necessary, and more. A medium is needed not only to execute bet but to record results, tally winnings and losses, transfer funds, stores and display bets along with other statements supported by bets.

Moreover, when used for communication, bets would usually support an ordinary statement: an article, a report, an ad, an editorial, etc.. The bets would support certain points in these conventional statements. And so, the new medium should allow users to also enter conventional statements and link those statements to the supporting bets.

Legal?

Whether cash bets are banned or not, people will still be able to make bets because people can bet points. These can be called Credibility Points (CP's). These are unquestionably legal to bet because they are free. They do not replace money because they are non-transferable. Money remains indispensable in many betting situations because it gives a unique incentive to win. Still, CP's can serve equally well in other situations and have the advantage of allowing anyone to bet regardless of financial situation. And so, this new medium would allow people to bet cash (if legal) and/or CP's.

Uses and Consequences

What are the possible uses and consequences of enabling people to bet routinely on all kinds of matters? That's hard to say. To see why, consider the printing press. It improved one of our basic activities, communicating, which means that the printing press has had far too many uses and consequences to summarize or even understand. While it's ridiculous to say that Bet Press and the Bet Central will have a comparable impact, the point is that they can have large and diverse effects because bets can improve several basic activities. How so? Well, bets can force people to be honest about what they know. That can improve communicating, discovering, thinking, deciding and doing.

SUMMARY

The bet has always been thought of as a form of entertainment or a vice. However, it is actually a fundamental method for keeping people honest. Bets can be used by people who want to demonstrate honesty by showing that they are willing to "put their money where their mouths are." Bets can also be used by people who want to challenge the statements of others by saying, basically, "You wanna bet."

We can devise a computer system that allows people to use bets efficiently in these ways, allowing people to place, accept and settle bets for the purpose of communicating. The system cuts out the middleman, sometimes referred to as the bookmaker or the house, enabling bettors to bet with each other directly. The system allows people to post bets, to accept bets, to change bets, to settle the bets, and to settle disputes. It also allows people to place special types of bets for the purpose of demonstrating probability estimates different from the estimates expressed in odds.

A bet used for communication can stand alone or can go along with another statement, which we will call a supported statement. The system disclosed allows people to link bets with corresponding supported statements.

BRIEF DESCRIPTION OF DRAWINGS

FIG. 5 shows a flowchart of the Accepting a Bet mode.

FIG. 6 shows a flowchart of the Changing a Bet mode.

DESCRIPTION

Overview

Figure 1A:
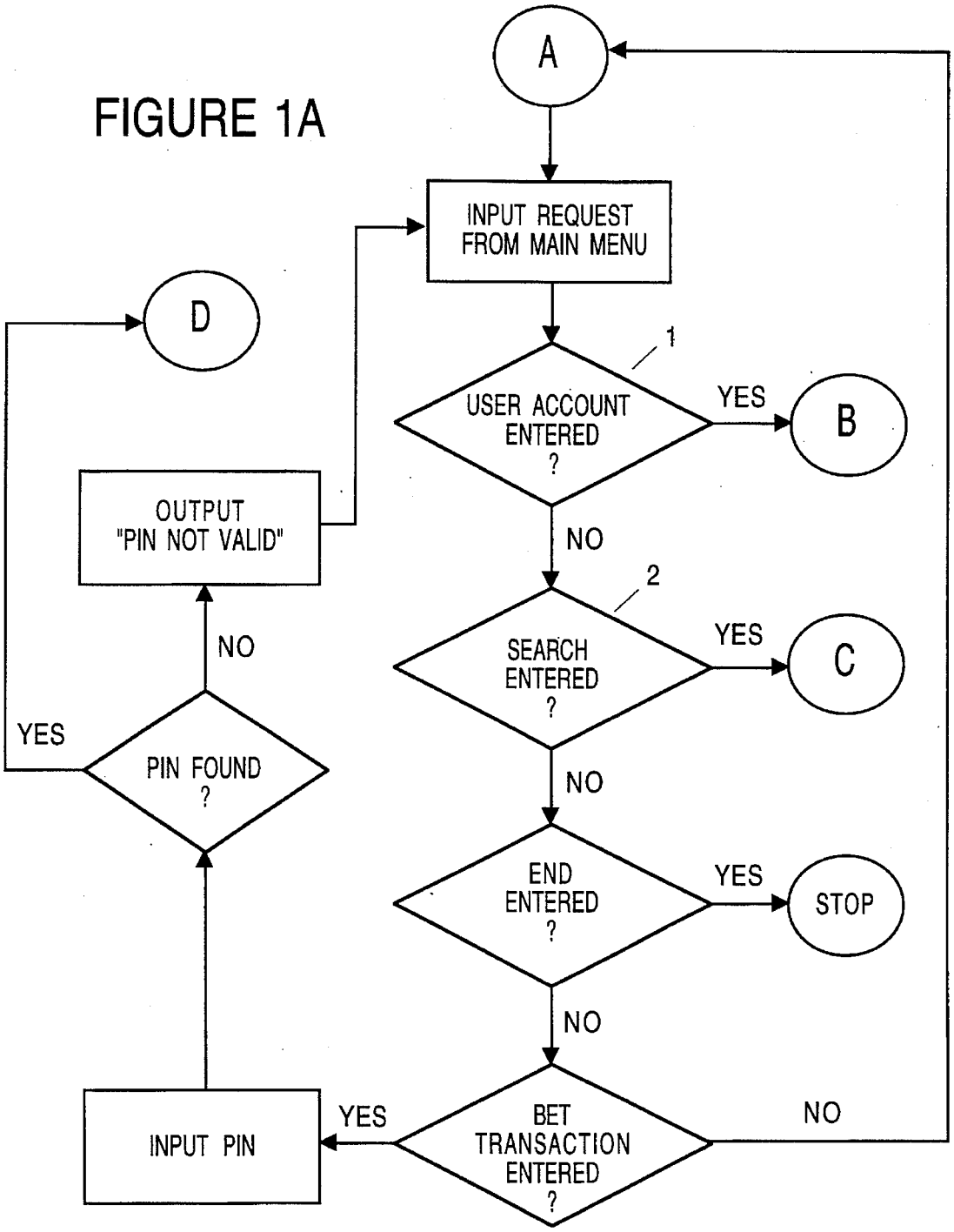
FIGS. 1*a* and 1*b* show a flowchart of the CSUB Main Menu.

The invention, a Communications System Using Bets (CSUB), is a special kind of data-base system that enables people to display, find, place, accept, settle, and record bets. The bets are made and shown for the purpose of expressing probability estimates in the honest, "put your money where your mouth is," way that only bets allow. Since honest probability estimates can be helpful for good communication, bets alone and bets attached to other statements, can improve communication.

The description of the CSUB is divided into several sections for clarity's sake. The features described are meant to be combined in a system. However, not all the features are essential, so it is possible to leave out features that are deemed superfluous in a given implementation of the invention. Section 1 is by far the longest and describes the basic system. The basic system enables people to transact the most familiar type of bet, which we will call a straight bet. The point is not to focus on this type of bet but to show the basic system for placing, accepting and settling bets.

In addition to straight bets, other types of bets can be useful for expressing probability estimates. Sections 2 and 3 describe how the system enables people to transact two of these bets, which we will call actual odds bets and range bets.

Section 4 describes how the system allows users to explicitly build an expected profit margin into the pay-off odds of the three types of bets.

While the CSUB can be implemented as just a system for transacting bets, its preferred embodiment is as a more versatile communications system where bets can be linked to other statements that are not bets. We will call these other statements, "supported statements." For example, a person can make a long argument about why inflation will rise and then make a bet supporting that long argument. The long argument though is not a bet. Section 5 describes how the system enables users to link bets and supported statements.

Section 6 describes a variety of other features that the CSUB can include. In the description, steps of the invention that are obvious and add nothing are omitted. For example, we will assume that the system usually gives users prompts before the users input information. A prompt might be something like, "Enter bet statement now." Since most prompts are obvious, they are usually be omitted.

As mentioned, the first section will explain the basic system and the other sections will add to it. When additional features are explained, we will usually not repeat steps that have already been given. We will mainly show differences between bet paths and take common steps, such as verifying the user and inputting the bet statement, to be understood. Some steps, however, will be repeated for clarity's sake.

This description and drawings make no pretense at being either the most efficient method of programming, or the best way to present users with options; the goal is to describe the key steps and functions of a CSUB. In many cases steps have been described that may be omitted in a given implementation of the CSUB. The description simply lays out the principles of the present invention. Numerous modifications and adaptations thereof will be readily apparent to those skilled in the art without departing from the spirit and scope of the present invention.

We begin with some definitions. More definitions will be supplied as needed.

Some Definitions

A Bet

A bet is an agreement entered into by two or more parties. For simplicity, we will consider bets between two parties. A bet agreement has four parts:

a. The Bet Statement

A bet statement is a statement that is designed to be found true or false. The statement can be practically any length from two words to several volumes.

b. The Sides

A bet has two sides, True and False. One party takes (bets on) True and the other takes (bets on) False. If the bet statement is found to be true then the party that bet on True wins. If the statement is found to be false then the party that bet on False wins.

c. The Stakes

In a bet each party puts an amount of something at risk. The amounts are called the stakes. The party that loses agrees to pay his/her stake to the party that wins. We will consider only bets where people risk things that can be counted in integer units, such as, money, toothpicks, chips, or points. Furthermore, we will only consider bets where people risk identical things. Thus, for example, people can risk money against money and toothpicks against toothpicks but not money against toothpicks.

d. The Pay-off Odds

The pay-odds are the proportion of the stakes risked in a bet. By convention, a convention we will follow, the odds are usually written in the form X–Y, where X represents the amount risked by the person who bets on False while Y represents the amount risked by the person who bets on True.

Pay-off odds can be stated in other ways though. In fact, the system disclosed makes it easy for bettors to state the pay-off odds in terms of percentages. Thus, a bettor can state the pay-off odds as a percentage, p, that the statement is true. This form is then converted into a conventional pay-off odds figure, X–Y. The formulas for converting pay-off odds to percentages and vice versa are well known. For example, p of True=Y/(X+Y). Thus, if the odds are 1-1 then p=1/(1+1)=50%. If the odds are 3-2 then p=2/(3+2)=40%.

We will also adopt the convention that when the pay-off odds are given in percentage form, the percentage, p, will be the probability that the statement is true. 1–p will be the probability that the statement is false.

(Note that the term "odds" has historically been confusing because people have used it to refer to two very different concepts. One is the controversial, perhaps metaphysical, concept of actual odds or actual probability. The other is a mechanical, concrete concept of pay-off odds. What is even more confusing is that the pay-off odds can be interpreted to indicate what a bettor thinks the actual odds are. That, in fact, is a key object of the invention, to allow people to express through the pay-off odds what they think about the actual odds.)

An Example of a Bet

Bet Statement: The consumer price index will rise at over 2% in 1995, according to the U.S. Commerce Department.
Odds: 3-1, 25% Pick: True Stake: $100

The Result

The Result of a bet is what each party determines about the truth or falsity of the bet statement. A party can report one of the following results:

a. True: The statement is found true.

b. False: The statement is found false.

c. Undecided: The statement is found neither true nor false. (For convenience, we take undecided to mean both undecided and undecidable).

Disputed Result

A disputed result means that one party finds that the statement is true or false or undecided and the other party disagrees.

Place a Bet

To place a bet means to offer a bet agreement. The party that does this is called the Placer.

Accept a Bet

To accept a bet means to accept a bet agreement. The party that does this is called the Acceptor.

Section 1: The Basic CSUB

Introduction. Form of the Invention

The CSUB is a computer system—including input/output means, memory means, processing means, and a program—that enables users to place, find, accept, change, settle, and record bets.

The system is a network of terminals connected to a central data-base unit. The terminals can be of various types such as PC's, telephones and textphones. Users enter data and requests through the terminals and receive responses from the central data-base unit. Users might also call human operators who use terminals to mediate between callers and the central data-base. By central data-base unit we mean that users communicate with the same body of data. The data may actually be located in multiple servers rather than in a single machine in a single location.

1A. Selecting a Transaction

Figure 1B:
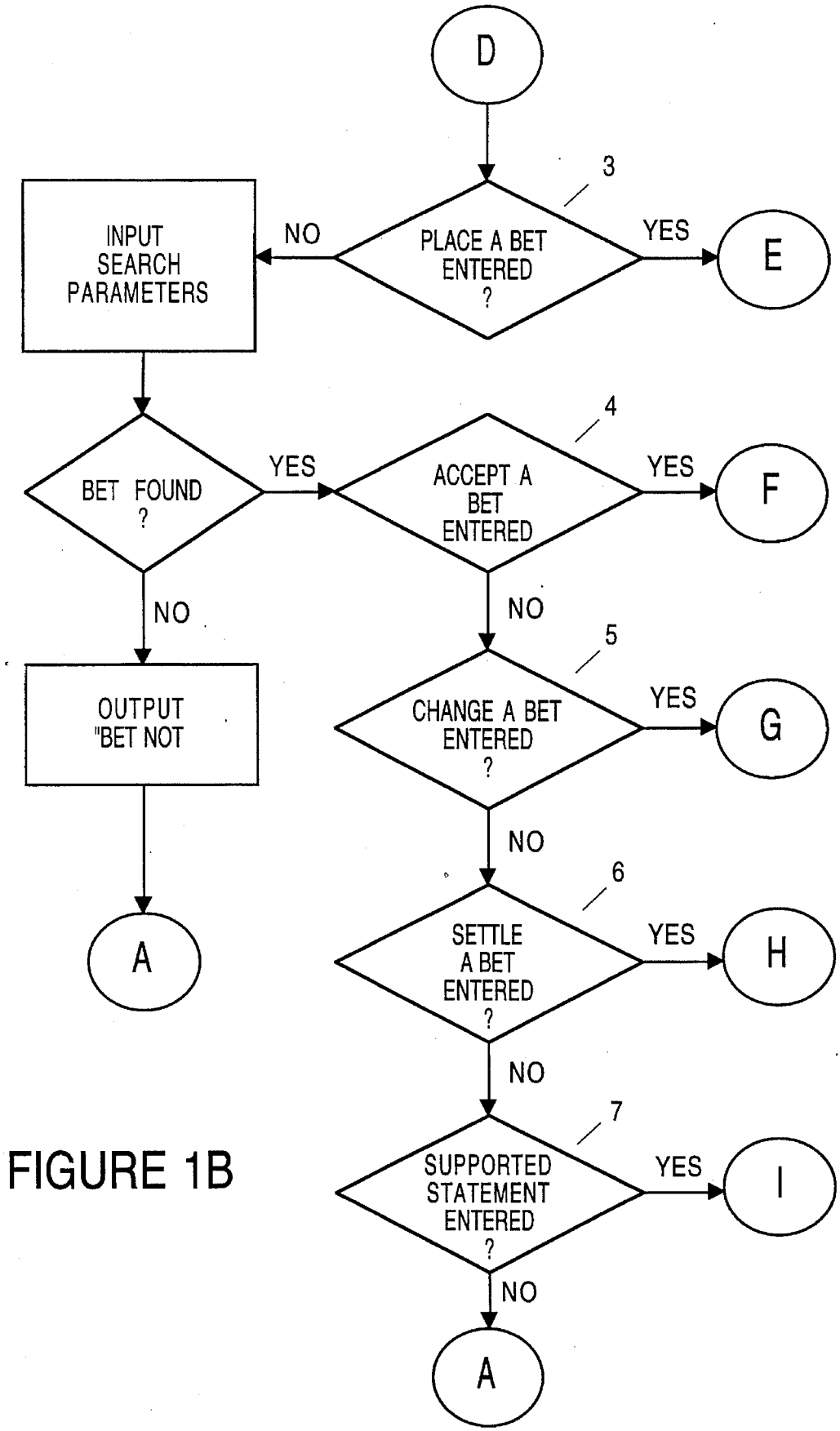

As shown in FIGS. 1*a* and 1*b*, the CSUB program includes steps for allowing users to select from several requests. We will call the list of requests the "main menu." It includes the following requests (which we will also call modes): user account 1, searching 2, placing a bet 3, accepting a bet 4, changing a bet 5, and settling a bet 6. FIG. 1*b* also shows an option to enter a supported statement 7. As mentioned, this option will be described in Section 5.

1B. Establishing and Accessing a User Account

The CSUB is a system to be used by a community of people. With it people can, as mentioned, place, accept, change and settle bets. For these transactions, and certain others, the system needs to identify users. And the identity of users needs to be verified. Therefore, the CSUB creates a record, also called an account, for new users. The system also issues user passcodes to correspond to these accounts.

(In a given CSUB, passcodes can be whatever user authentication information is most suitable, such as passwords, voice prints, or other known means. We will use the term PIN to represent all passcodes.)

The CSUB can store various pieces of useful information in the user's record. A list of useful information follows. A given implementation of the CSUB may or may not store all the information in this list. (Also note, the list below is not exhaustive and the user's record could include other information.)

A user's name can be stored.

A user's contact data (such as E-mail address, regular mail address, voice number, fax number) can be stored. This information enables the CSUB to send the user a message when necessary, especially a message alerting a user as to the status of her bet(s). Without this alerting step, which is described later, a user would have to keep checking the system to learn the status of her bets. Indeed, the CSUB can include an E-mailbox or voicebox for each user to which the system sends information updating the status of bets. Users can then check their personal boxes periodically rather than checking all their bets.

A user's billing data (such as a credit card number) can be stored. This information obviously enables the CSUB to bill users.

A user's credit/debit data for bets can be stored. This information allows the CSUB to credit winners and debit losers when bets are settled and tell users how much money or other commodity they have in their account.

A user's bets and bet results can be stored. This information enables the CSUB to compile a history of a user's bets and statistics on the user's performance.

Figure 2:
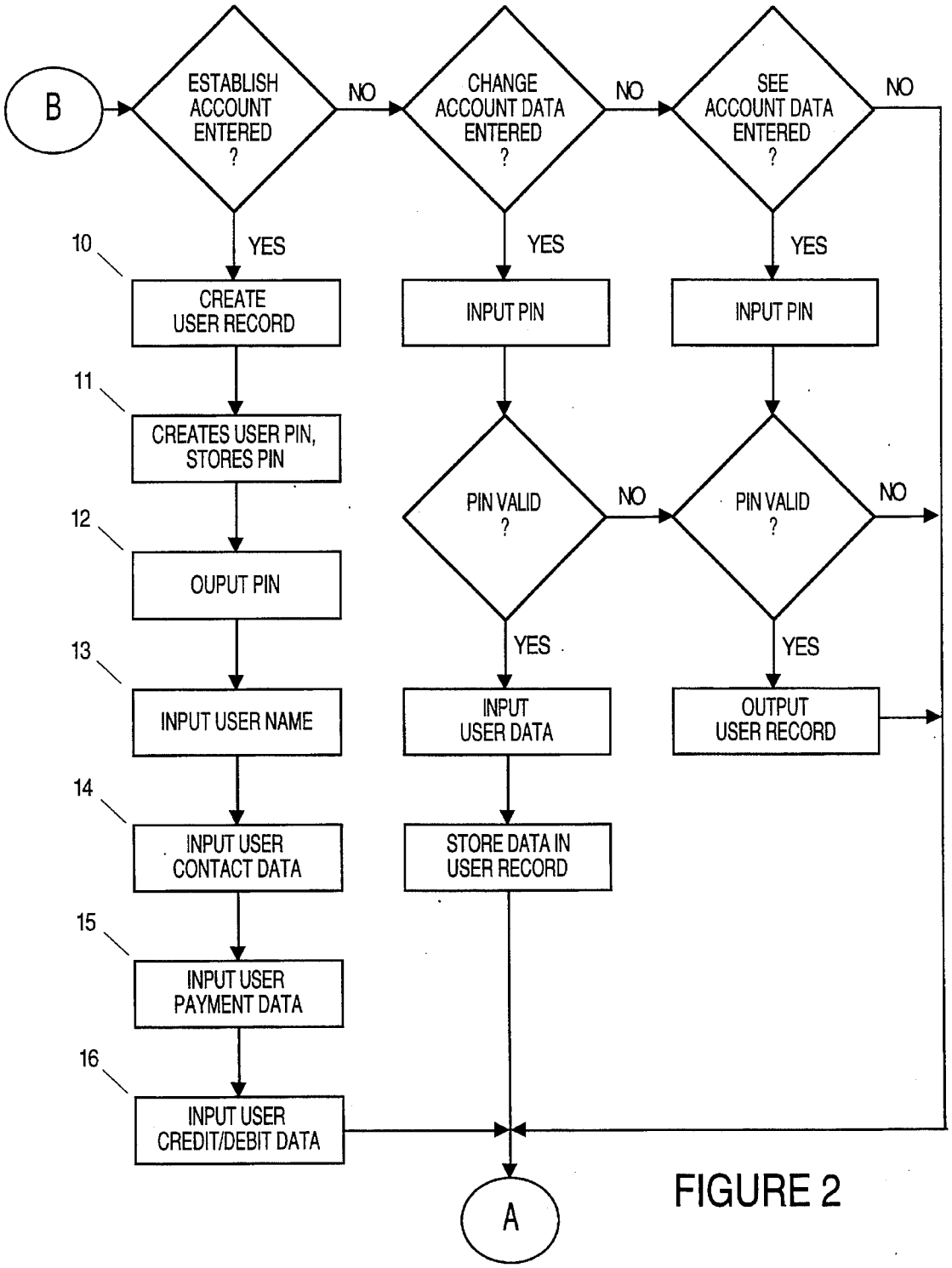
FIG. 2 shows a flowchart of the User Account mode.

Thus, as shown in FIG. 2, the CSUB program includes the following steps, for storing user data:

creates a user record 10 for identification data, contact data, billing data, credit/debit data, bet data, and bet result data, creates a user PIN and stores it 11 in user's record, outputs PIN 12 to user, inputs and stores user's name 13, contact 14, billing 15, and credit/debit 16 data.

There is no sense in compiling a user record if no one is going to access it. Naturally then, a CSUB includes means for enabling user's to access their records and change certain data in them if necessary. For example, a user might want to change his contact number or might want to deposit money in his account.

Depending on the rules of the particular CSUB, the system can restrict access to a user's account by PIN or can allow unrestricted searches of people's records. In a CSUB, it is very useful to allow others to see one's records in bets so that people can judge one's performance. Hence, a user might be able to authorize others to search her record. The authorization could be by a different passcode that could be valid for a given period of time. The point though is not to describe various possible ways that a user's records can be accessed. These are well known. The point is just to note that the CSUB would include steps for allowing a user to, change certain data in her record, output her record, and allow others to output her record.

1C. Searching

Figure 3:
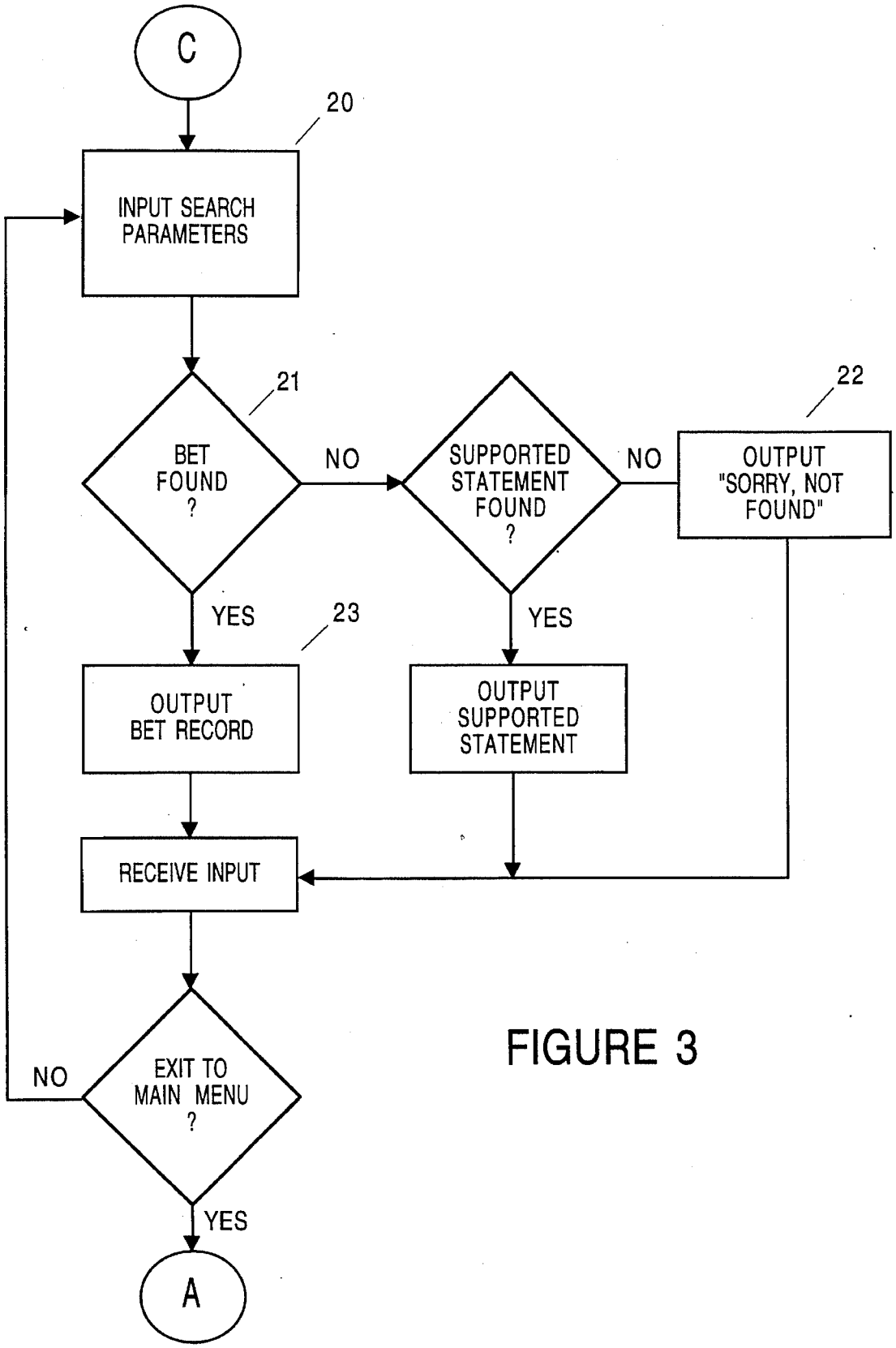
FIG. 3 shows a flowchart of the Search mode.

The CSUB is both a transaction processing system that enables users to execute bets and a data-base system that enables users to record and see bets. As a data-base system, it naturally includes search functions. In FIG. 3 we see that users can search both bets and supported statements.

Depending on the particular CSUB, users may be able to search without having an account. Having two classes of users, those with accounts and those without, lets a larger community use the CSUB as a data-base. We assume the system allows users to search without entering a PIN.

(It is possible for a CSUB to allow users to go from the search mode directly into the transaction mode. Thus a user might find a bet while searching and then enter a request to do a transaction. The user would then enter his PIN and execute the transaction on the bet. This path is not shown but is easily implemented.)

Thus, as shown in FIG. 3, the CSUB program includes the following steps for enabling users to search the system's data-base of bet records:

inputs 20 search parameters for a bet, checks 21 to see if bet is in memory, if bet is not found, outputs 22 message saying that no such bet is found, if bet is found, outputs 23 the bet.

1D. Placing a Bet

When a user places a bet, it means that he makes a statement, sets the pay-off odds, commits to picking a side, True or False (though he may not specify which side), and puts a stake at risk.

As will be seen later, there are a variety of different bets and they are distinguished by how the odds are set and how the sides are picked. The basic system being described in this section enables the user to place the most familiar type of bet, which we will call a "straight bet." In a straight bet, the Placer supplies a single pay-off odds figure and picks the side of the bet.

As mentioned, in conventional betting, pay-off odds are supplied in X–Y form. However, as befitting a medium that is made for expressing of probability estimates, the CSUB also converts odds in X–Y form into percentage form. And the system allows odds to be entered in percentage form instead of X–Y form, if a user so desires. For example, a person might place the following bet:

Bet Statement: "The Knicks will win tonight,"

Stake: $100

Side Picked True

Pay-off Odds 40%.

The CSUB would then convert these odds into X–Y form (3-2).

In everyday life, people usually express probability figures in percentage form. For example, people usually say, "there is a 25% chance of rain" rather than, "the odds are 3-1 against rain." In fact, most people are unfamiliar with how probability expressions in X–Y form correspond to those in percentage form. So it is quite useful for a CSUB to enable people to set pay-off odds and actual odds using percentages. Therefore, with every type of bet the CSUB enables users to transact, the CSUB allows users to input probability figures in X–Y form or percentage form.

When the user places a bet, the CSUB creates a record for that bet where the bet information is stored. Initially, this information includes the bet terms (for a straight bet: the bet statement, the Placer's stake, the pay-off odds, and the side picked). In addition, the user's PIN is stored to verify the user. The type of bet can be stored as well, or can be understood from the bet data.

Any additions or changes to the bet information, such as the bet being accepted, are stored in the bet record as well. The record can also be linked to a supported statement and to other bets, as will be described later.

Figure 4A:
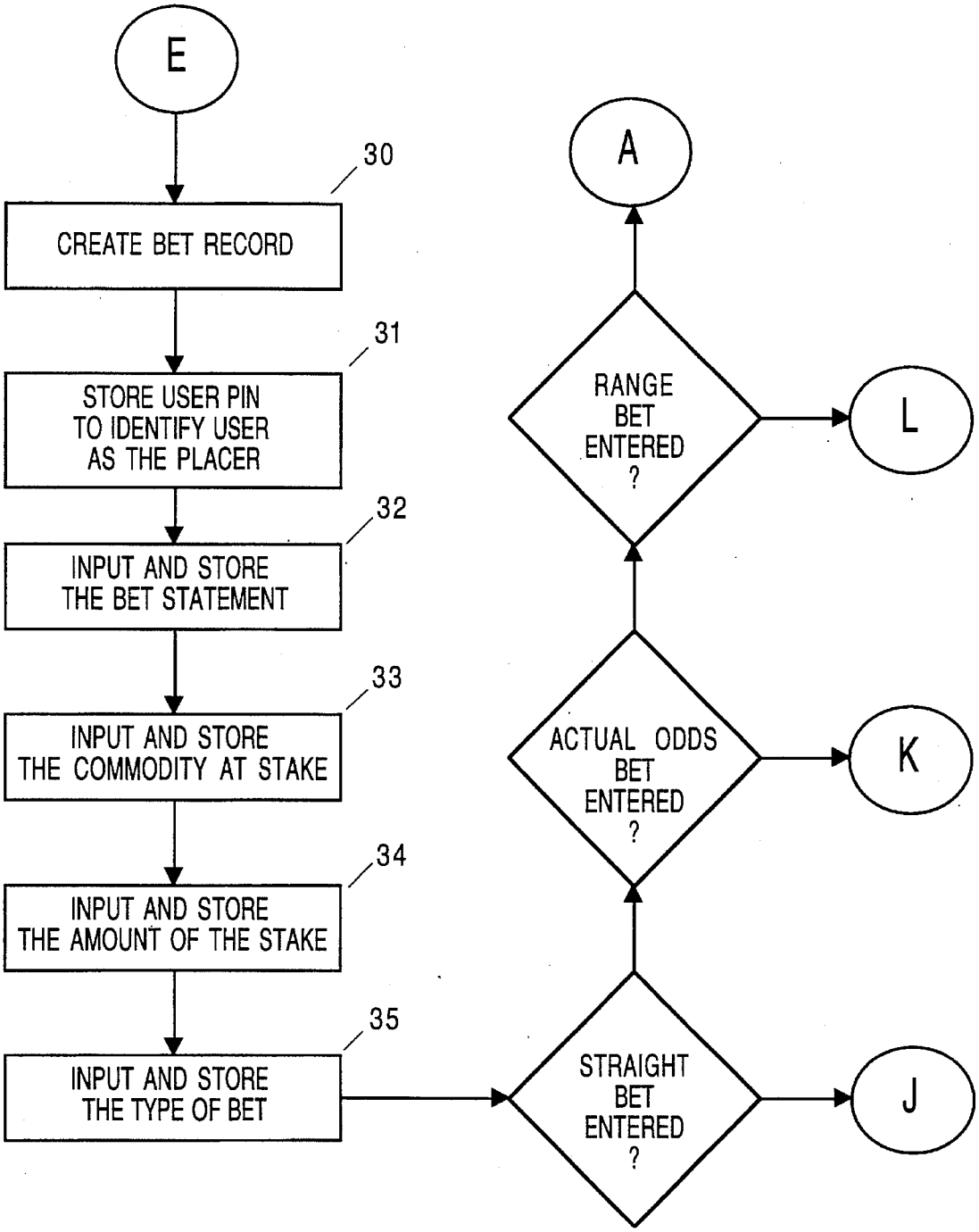
FIGS. 4*a* and 4*b* show a flowchart of the Placing a Bet and Straight Bet modes.
Figure 4B:
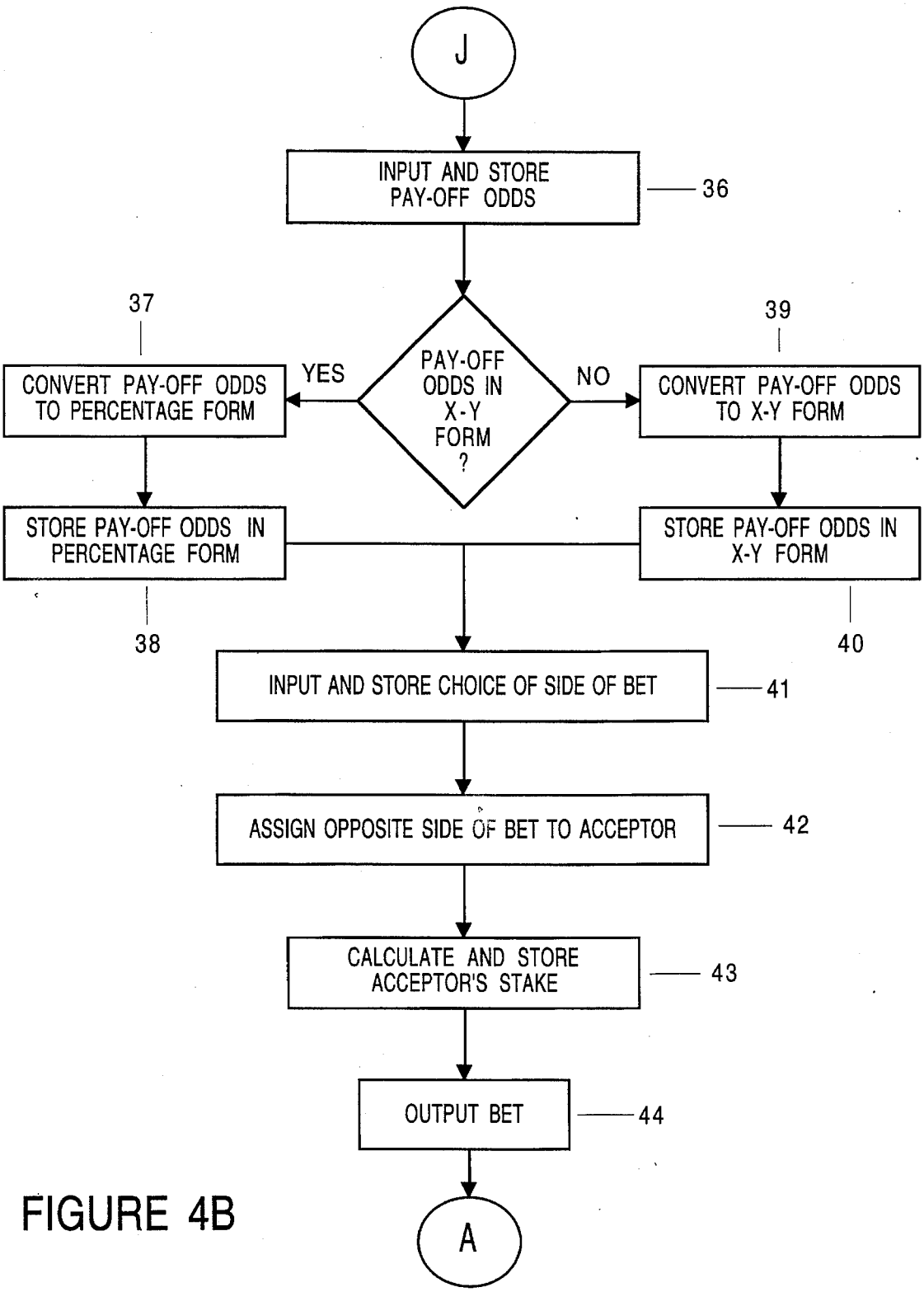

Thus, as shown in FIGS. 4*a* and 4*b*, the CSUB program includes the following steps for enabling users to place a bet:

creates 30 a record to store the bet data in, stores 31 the user's PIN in the record to identify the user as the Placer of the bet, inputs and stores 32 the bet statement, inputs and stores 33 the type of commodity being bet (we assume users can bet one of two types of commodities, money and points, and that the system prompts the user to enter one or the other), inputs and stores 34 the amount at stake, inputs and stores 35 the type of bet (we assume the user enters "Straight Bet")

inputs and stores 36 the pay-off odds, if the odds are in X–Y form, converts 37 them to percentage form, stores 38 them in percentage form as well, if the pay-off odds are in percentage form, converts 39 them to X–Y form, stores 40 them in X–Y form as well, inputs and stores 41 the side of the bet that the user is taking, assigns 42 the opposite side to the Acceptor, calculates and stores 43 the Acceptor's stake required to cover the bet, outputs 44 the information stored in the bet record (also called outputting the bet).

1E. Accepting a Bet

We saw in the main menu, FIGS. 1*a* and 1*b*, that when a user wants to accept, settle or change a bet, he first enters his PIN along with information to identify the bet. The system finds the bet and then the user is able to do the transaction.

When a user accepts a bet, the bet has already been placed by another user. Thus the main task of the Acceptor in a straight bet is to enter an acceptance of the bet terms. (In a straight bet, the Placer has already picked one side of the bet. As mentioned, there are other types of bets where the Acceptor picks the side.)

Thus, as shown in FIG. 5, the CSUB program includes the following steps for enabling users to accept bets:

checks 50 to see if the bet has already been accepted, if yes, outputs 51*a* message, "bet has already been accepted,"

if no, stores 52 user's PIN to identify the Acceptor of the bet, checks 53 whether the type of bet is a Straight Bet, if no, goes to steps for accepting other bets, if yes, stores 54 acceptance and alerts 55 the Placer of the acceptance.

The system can use two basic ways to alert the Placer that the bet has been accepted. The system can include a message box for users and send the alert to that box. Or the system can send the alert to the user's contact number.

The acceptance procedure above works fine in situations where the Placer is satisfied with the bet terms, at the exact time the bet is accepted. Leaving the CSUB aside for a moment, imagine two people are making a bet. One person proposes the bet and the other accepts. The two shake hands and the bet is set. The handshake signifies that the two parties have agreed on the terms at the exact same time.

This simultaneity is part of most bet agreements but it is implicit and not usually brought out into the open. Without simultaneous agreement, the Placer of a bet may have to constantly monitor the terms of the bet. For example, bookie shops that give odds on horse races must constantly monitor those odds. Or, the Placer may have to arrange to be alerted immediately after the bet has been accepted and reserve the fight to change the terms. For example, bookie shops often post odds that are subject to confirmation by shop managers.

The reason that the terms need to be agreed to by both parties at the same time is that the conditions that a bet is about might change. Thus, a party can be at a disadvantage if he leaves a bet "on the table," while the other party has risk-free time to think. And that poses a problem concerning the CSUB.

The CSUB is not designed for professional bettors, but for ordinary people who want to express probability estimates through bets. These people do not want to spend their time constantly monitoring the terms of their bets.

Hence, the CSUB needs to have a way for both parties to agree while giving neither party an advantage. Ideally, the bet agreement would be simultaneous, but we have established that is often impractical. To solve this problem, the CSUB can employ a time limit method. In this method, once an Acceptor has accepted a bet, a time clock is started with a given time limit. Before the time expires, either party can back out of the bet. After the time has expired, neither party can back out. So, if the time expires with neither party having backed out, the bet acceptance is confirmed.

Thus, as shown in FIG. 5, the CSUB program can include the following steps for enabling people to accept bets:

after storing acceptance, starts clock 56 with a pre-set time limit (we assume here that the time limit is set by the system operator), when the time expires, checks 57 to see if either Placer or Acceptor has canceled the acceptance, if yes, does nothing to the bet record (the record will already have been changed in the Change Bet mode)

if no, stores 58 confirmation of acceptance.

Now it is important to point out that the acceptance procedures outlined are not the only ones possible. For example, rather than the time limit being pre-set by the system operator, it is possible to allow the Placer to set the limit. The Placer might not even care to set a limit but might be confident enough to leave a bet on the table for anyone to accept.

Acceptance and retraction rules are crucial parts of bet agreements and the rules can vary widely. Here we have just tried to give a useful and novel feature that a CSUB can include; we have not tried to say it the only good procedure for accepting bets. Different rules can coexist within a single CSUB, as long as they are applied to different bets. These rules can be determined by users or system operators. For example, it might be possible for a person to back out of a bet by paying a certain penalty within a set amount of time from when the bet was accepted.

Now it is also important to point out that the system can enable multiple users to accept a bet. The users would each put up a fraction of the Acceptors stake. There are many possible ways to determine what fraction each Acceptor would get. For example, two users might want to accept a bet. The rules for deciding how much each would get are important and can vary widely. For now, for simplicity's sake, we will not illustrate the option of allowing multiple users to accept a bet, but we note that the option is easily implemented by those skilled in the art.

1F. Changing a Bet

As previously mentioned, an important part of bet agreements are the rules for changing the bets. One common rule on changing bets is that a bet can be changed or canceled if it has not yet been accepted. The CSUB includes steps that implement this rule. The CSUB can include steps that also implement the time limit method outlined above. These steps will be described below. In this set of steps, the Placer can change the terms of the bet, if the bet has not been accepted. Once the bet has been accepted, neither party can change the terms unilaterally, but both can back out of the bet before the time limit expires.

Thus, as shown in FIG. 6, the CSUB program can include the following steps for enabling users to make changes in a bet:

verifies 60 that user is the Placer or Acceptor, checks 61 if the bet has been accepted, if the bet has not been accepted, receives input 62 from the Placer, checks 63 if input is to cancel or change the bet, if input is to cancel the bet, cancels the bet 64, stores 65 the cancellation in the Placer's record, alerts 71 Acceptor of cancellation, if input is to change the bet, inputs 66 and stores 67 the changes, if the bet has been accepted, checks 68 whether acceptance is confirmed (time limit has expired), if yes, outputs message 69, "No changes allowed now,"

if no, checks 70 whether the user is the Placer or Acceptor if the user is the Placer, cancels the bet, stores the cancellation in the Placer's record, alerts the Acceptor of the cancellation, if the user is the Acceptor, cancels 72 the acceptance, stores 73 the cancellation in the Acceptor's record, alerts 74 the Placer of the cancellation.

We assume in the procedure above that when the Placer cancels the acceptance that the whole bet is canceled but that when the Acceptor cancels the acceptance, the bet is still open for others to accept. That was why we distinguished between a request to cancel the bet and a request to cancel the acceptance of the bet. However, it is equally possible to include steps whereby the bet is kept open after the Placer has backed out. In this case, the Placer's side can be taken by some other user.

Another typical rule of bet agreements is that once a bet has been accepted, changes can be made by common consent. The CSUB can include steps that implement this rule whereby a certain input would signify that a party wanted to make a change. The party would enter the change. The system would alert the other party that a change was requested and tentatively entered into the record. Another input would signify whether the other party agreed to the change or not. The change would be made part of the bet only if the other party entered this confirming input.

1G. Settling a Bet

The basic CSUB procedure for settling a bet is simple. When both sides enter the same result, the bet is settled. The parties can enter a result of true or false or undecided. Each reported result is considered verified by the user's PIN and so the settlement is considered verified in the same way. If a matching result is reported, the result is stored as the settle result in the bet record and in each user's record.

Once the bet is settled, the system completes the transaction by crediting the winner by the loser's stake and debiting the loser that same amount. If both sides report "undecided," this result means the bet is a push; the system gives neither party the other's stake. If a particular CSUB executes funds transfers, it transfers the loser's stake into the winner's account.

All the above presumes that the bet is settled. Of course, the parties can disagree. They can disagree by reporting different results. Or one party can enter a result while the other reports nothing. In these cases, the bet is not settled. Therefore, the CSUB needs a step where a human judge can be called by one or both of the parties in a bet. (The CSUB could include a rule whereby a party could only call a judge after a given period of time after having reported a result.) Rules for dispute resolution vary widely and are not a matter of concern here. What is important is that the CSUB includes means for enabling the parties to call a judge if either so desires. And further, the CSUB needs to include means for enabling the judge settle the bet and enter the result into the bet record and into the users' records (these steps are not shown but are easily implemented).

Figure 7:
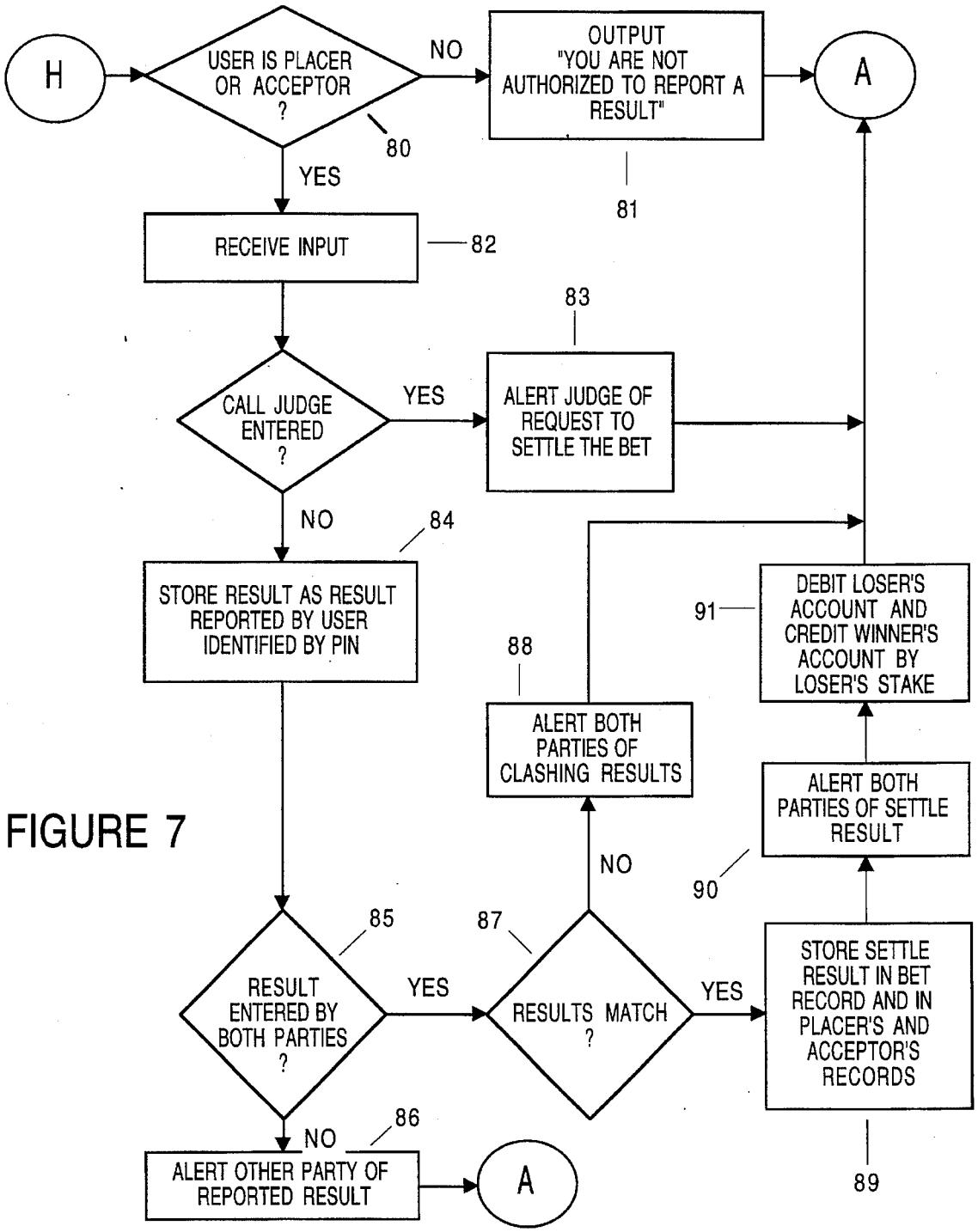
FIG. 7 shows a flowchart of the Settling a Bet mode.

Thus, as shown in FIG. 7, the CSUB program includes the following steps for enabling users to settle bets:

checks 80 user PIN to see if user is either Placer or Acceptor if no, outputs message 81, "You are not authorized to report a result,"

if yes, receives an input 82 (a call for a judge or a bet result), if the input is a call for a judge, sends a message 83 to a CSUB judge, if the input is a bet result, stores 84 the result in the bet record under the user identified by the PIN, checks 85 to see if results have been entered by both parties, if no, alerts 86 the other party of the result reported, if yes, checks 87 to see if results match, if the results do not match, alerts 88 both parties of the clashing results, if the results match, stores 89 the settle result in the bet and users' records, alerts 90 users that bet is settled, credits 91 the winner's account and debit's the loser's account by the loser's stake.

Section 2. Actual Odds Bets

The previous section described the basic system for transacting bets. The system described was limited though to transacting straight bets. We now describe additional means by which the system enables users to transact what we will call actual odds bets.

In an actual odds bet, the Placer sets the bet statement, the stake, and the pay-off odds but lets the Acceptor pick the side.

When the Placer lets the Acceptor pick the side, the Placer must strive to make the pay-off odds fair, presuming the Placer does not want to make an unfavorable bet. Fair pay-off odds equal the actual odds. Therefore, the theory is that the Placer will strive, in the pay-off odds, to express his best estimate of the actual odds. Hence the name of the bet.

For example, if the bet statement is: "This coin will land on heads," and the actual odds are 1-1, the Placer should set the pay-off odds at 1-1. If he sets them at anything else, he lets Acceptor bet on the favorable side. Say the Placer sets the pay-off odds in this case at 1-2 that the statement is True (Heads), which means that False (Tails) is paying 2-1. The Acceptor would presumably pick False, leaving the Placer with a very poor bet on True at 1-2.

Since a key object of the invention is to enable people to express their best probability estimates in a convincing way, the actual odds bet is a useful type of bet for a CSUB to include.

(Note, we presume that the controversial concept of actual odds, also called actual probability, has some meaning outside of coin and casino type examples. We do not go into the philosophy involved.)

Figure 8:
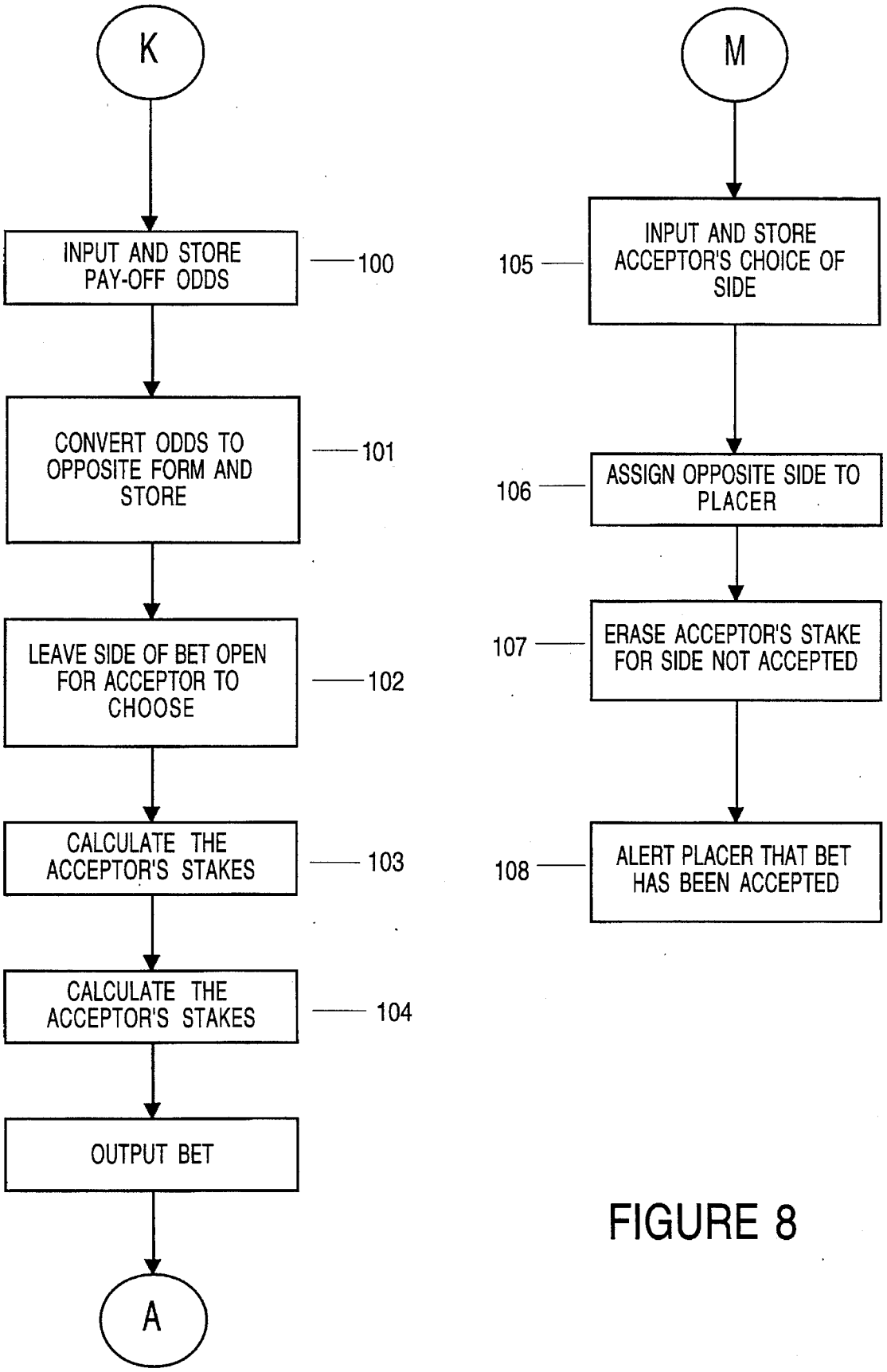
FIG. 8 shows a flowchart of the Actual Odds Bet mode.

Thus, as shown in FIG. 8, the CSUB program includes the following steps for enabling users to transact actual odds bets:

(As mentioned in the Overview, we add to the basic description rather than repeat steps previously mentioned.)

In Placing a Bet mode:

inputs and stores 100 the pay-off odds, converts 101 the odds into opposite from and stores them in that form as well, leaves 102 the side of the bet uncommitted and left for the Acceptor to choose, calculates 103 the Acceptor's stakes, one for each side the Acceptor can take, stores 104 the Acceptor's stakes, outputs the bet record.

In Accepting a Bet mode, inputs and stores 105 the Acceptor's choice of side, assigns 106 the opposite side to the Placer, erases 107 the Acceptor's stake corresponding to the side not chosen, alerts 108 the Placer that the bet has been accepted and tells which side the Acceptor has chosen.

The system can also include steps whereby the Placer can specify two different stakes, depending on which side the Acceptor takes. These steps can enable the Placer to specify one amount to be risked on True and another amount to be risked on False. We will not illustrate this option but it is easily implemented.

Section 3. Range Bets

We now introduce a third kind of bet, which we will call a range bet. A range bet is based on the fact that people often state probability estimates in terms of ranges. For example, a person might say that the chance of rain is 10% to 20%. Since people often express probability this way, it is useful to have a bet that reflects this kind of estimate.

People can, of course, express a range in terms of odds in X–Y form, for example, the odds of rain are from 9-1 to 8-2.

For the sake of simplicity we assume fight now that the probability estimates are expressed in a range of percentages from p1 to p2 inclusive, where p1<p2. In other words, we take the range estimate to mean that a person thinks the probability that the bet statement is true, p(True), is:

$$<=p(\text{True})<=p2.$$

This means equivalently that the person thinks that p(False) is:

$$1-p2<=P(\text{False})<1-p1.$$

For example, if the probability of rain is 10%–20% then the chance of no rain is 80%–90%.

In a range bet, the Placer states a range of probabilities from p1 to p2, that the bet statement is true and offers to bet on True with pay-off odds corresponding to p1, and offers to bet on False with odds corresponding to 1–p2. In other words, the person offers to bet on True at the highest pay-off odds for True in the range and offers to bet on False at the highest pay-off odds for False in the range.

The system also enables a user to express the range of probabilities in X–Y form. If we say the range is (X+Z)–Y to (X–Z)–Y then the Placer is willing to bet on True at (X+Z)–Y and on False at (X–Z)–Y. People would usually not keep the same Y but would state a range more naturally. For example, the actual odds might be 17-3, corresponding to p(True)=15%. A range of 5% both ways would then mean a range of 9-1 (10%) to 8-2 (20%).

And so, in a range bet the Placer creates two straight bets with the same bet statement but with different pay-off odds, one set for betting on True and one for betting on False.

An Acceptor picks one of the two bets. The other bet is then canceled.

Figure 9:
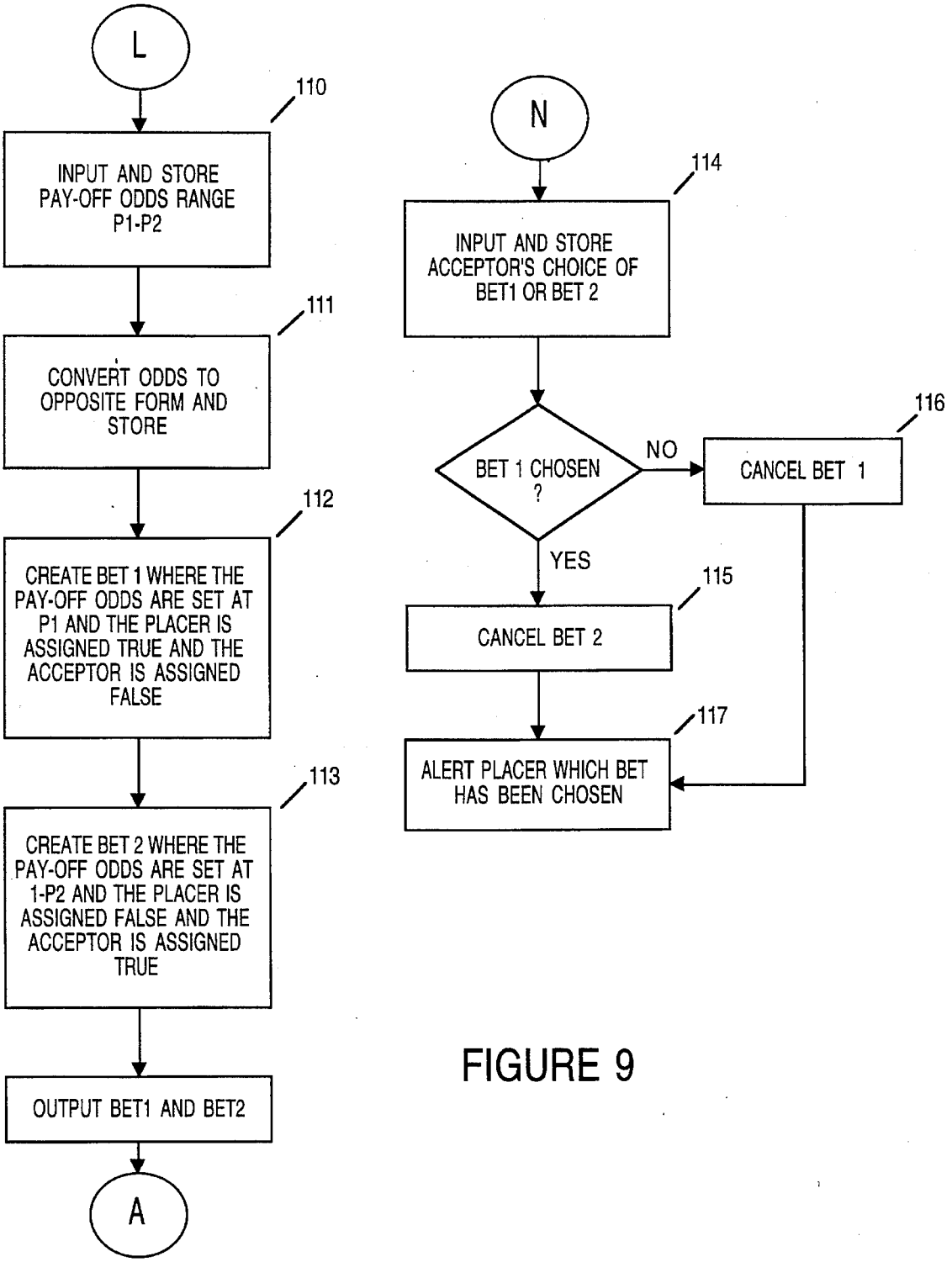
FIG. 9 shows a flowchart of the Range Bet mode.

Thus, as shown in FIG. 9, the CSUB program includes the following steps for enabling users to transact range bets:

In Placing a Bet mode, inputs and stores 110 pay-off odds range if range is entered in percentage form p1–p2), converts 111 it to X–Y form, if the range is entered in X–Y form, converts it to percentage form, creates 112, 113 two bets in the bet record for the Placer by using the same bet statement and stake, one bet where the system assigns True to the Placer at pay-off odds corresponding to p1 and one where the system assigns False to the Placer at pay-off odds corresponding to 1−p2, outputs the bet record.

In Accepting a Bet Mode, inputs and stores 114 which of the two bets the Acceptor chooses, if bet 1 is chosen, cancels 115 bet 2, if bet 2 is chosen, cancels 116 bet 1, alerts 117 the Placer which bet has been accepted.

As with an actual odds bet, the system can include steps for enabling the Placer to specify an amount to be risked on True and a different amount to be risked on False. We do not illustrate this option but note that it is easy to implement.

Now you might notice that a person could, as a bookmaker does, try to make a profit by betting both ways at different pay-off odds. In order to stop such attempts, the second bet in a range bet is canceled. This step cannot really stop a bettor who wants to hedge his position, or create a profitable spread in a double bet. Yet, by showing a user's record, the system can reveal the user's strategy and the meaning of his bets. People can see then that a Placer who makes a double bet is really saying nothing about his opinion of probability, only that he smells a profit in creating a spread, as a bookmaker does. Section 6 (under lock-in procedures) discusses this issue further. Let's also note that another type of range bet is possible. In this bet, a Placer states a range of probability and then offers to make a bet on either True or False, at any pay-off odds within that range. This type of bet is mentioned because it is another viable way to enable a person to express that he believes a probability to be anywhere within a certain range. We will not discuss this bet further. We simply note that it is a potentially useful bet that is easily implemented within the CSUB.

Section 4. Bets With Explicit Profit Margins

We have described three types of bets: straight bets, actual odds bets, and range bets. In both a straight bet and a range bet, the Placer will often try to set the pay-off odds favorably for himself. But in an actual odds bet the Placer intends the bet to be fair, to be a break-even bet. This can be a problem because the Placer may want to express an actual odds estimate in the pay-off odds and at the same time build a profit margin into those odds.

A variation of the actual odds bet can allow a Placer to state actual odds and a profit margin and combine those two figures into the pay-off odds. Because we are dealing with a bet, the profit margin is not certain; it is an expected profit margin (EPM).

The general formula for calculating an EPM in a bet is well known: If the actual odds are X1−Y1, then for betting on True:

$$Y1/(X1+Y1)\times(X2+Y2)=Y2(1+EPM)$$

X2−Y2 are the pay-off odds corresponding to the desired EPM. In English this equation means that for the bettor who picks True, the actual probability of winning (Y1/(Xi+Y1) is multiplied by what is in the pot (represented by X2+Y2) yielding the expected winnings. These equal the bettor's stake (represented by Y2) multiplied by 1+the EPM.

We recall that in an actual odds bet that a Placer lets the opponent, the Acceptor, pick the side. Thus, if a Placer builds an EPM into the pay-off odds, he must create two bets, like a range bet. In one bet he picks True and in the other he picks False. The two bets have different pay-off odds, each set to yield the desired EPM for the Placer. (This principle is well known and is often relied upon by bookmakers, though bookmakers usually estimate how the public will bet rather than estimate the actual odds.)

One might ask what then is the difference between an actual odds bet with an EPM built in and a range bet? The difference is one of identifying how the pay-off odds were arrived at, which is important if one wants to express a probability estimate through the pay-off odds.

The Placer of a range bet is in effect saying, "I think the probability that the bet statement is true is a range from this percent to that percent." The Placer of an actual odds bet with an EPM is in effect saying, "I think the probability that the bet statement is true is this percent and I would like this profit margin built into my bet." For example, if a person is placing a bet on whether a coin will land on heads or not, he might say that the actual probability is 50% and that he wants a profit margin of 10% built into his bet. This is different than saying he thinks the actual probability is between 45% and 55% that the coin will land on heads (though the pay-off odds in the two bets are nearly identical).

It is useful then for the system to enable Placers to specify and explicitly display figures for the actual odds and an EPM.

And so, in an actual odds bet with an EPM, the Placer sets the actual odds and sets an EPM, which means that the Placer offers to bet on True at the actual odds modified to give the Placer the desired EPM, and to bet on False at the actual odds modified to give the Placer the desired the EPM.

Figure 10:
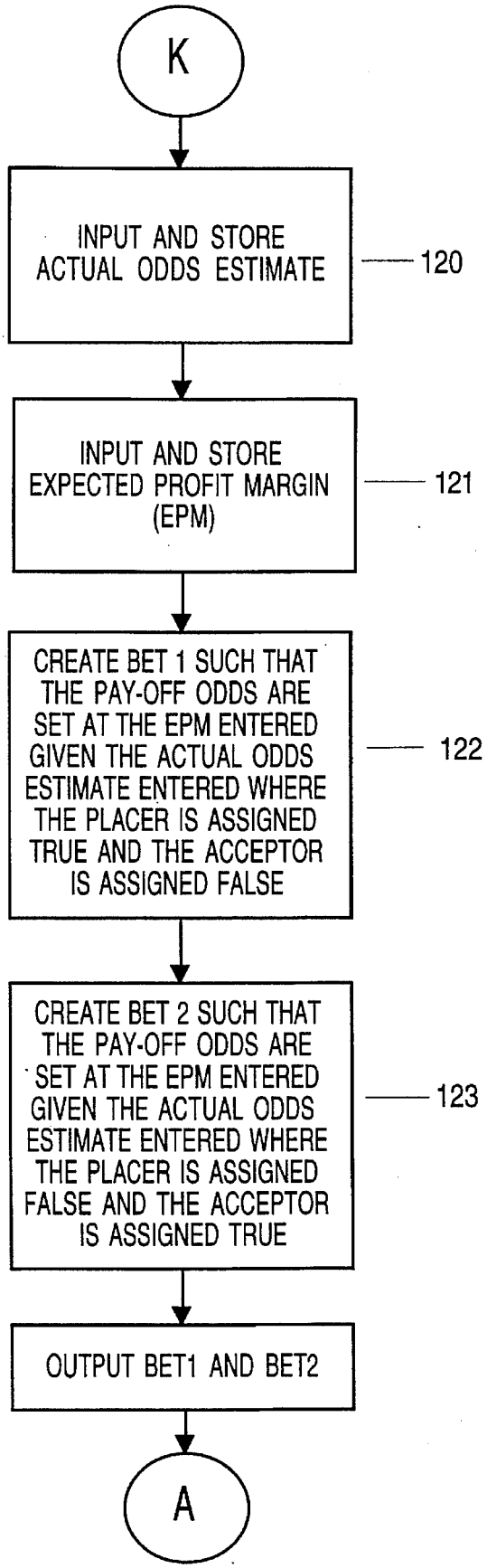
FIG. 10 shows a flowchart of an expected profit margin function.
Figure 11:
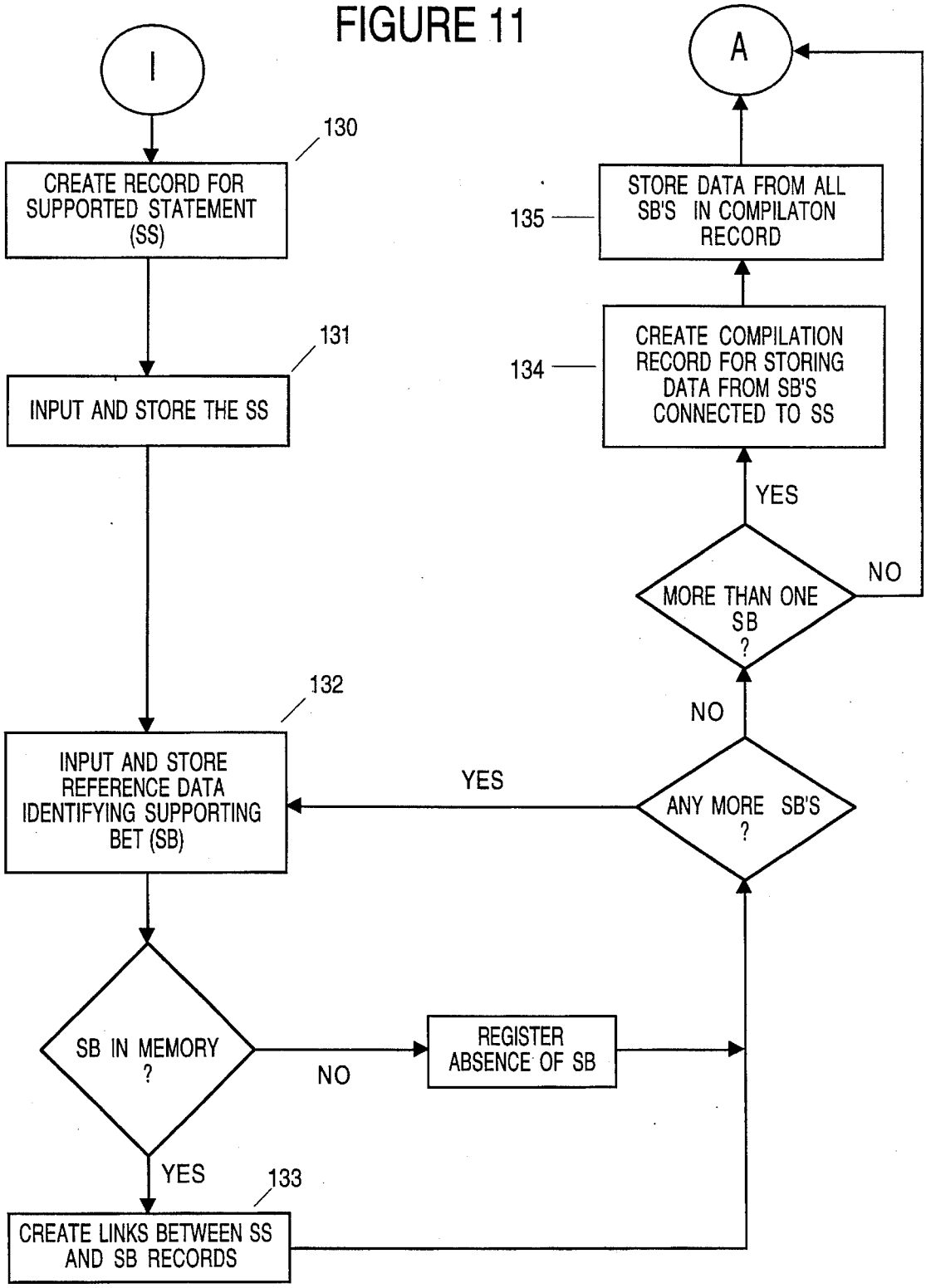
FIG. 11 shows a flowchart of the Supported Statement mode.

Thus, as shown in FIG. 10, the CSUB program includes the following steps for enabling users to place actual odds bets with an EPM built into the pay-off odds:

In Placing a Bet mode, inputs and stores 120 the actual odds estimate, inputs and stores 121 the desired expected profit margin (EPM), creates 122, 123 two bets in the bet record for the Placer by using the same bet statement and stake, one bet where the system assigns True to the Placer at pay-off odds set to yield the Placer the EPM entered, given the actual odds entered, and one bet where the system assigns False to Placer with pay-off odds set to yield the Placer the EPM entered, given the actual odds entered, outputs the bet record.

In Accepting a Bet mode, the steps are the same essentially as for accepting a range bet.

Now it may be that a Placer of a straight bet might also want to build a profit margin into the pay-off odds. But in a straight bet there is no actual odds estimate and thus no EPM. But we can interpret a straight bet so that we can build in a minimum EPM. This term means, of course, that the Placer thinks the EPM is greater than or equal to the minimum EPM specified.

We say that in a straight bet, the actual odds are greater than or equal to the pay-off odds. We then pretend that the pay-off odds are equal to the actual odds. We then build in the desired EPM at these pretend actual odds, but only for the side, True or False, that the Placer has picked. These pay-off odds then have a minimum EPM built into them.

For example, say a person offers to bet, at 3-2, on True, that a coin will land on heads, and that the person wants a minimum EPM of 20%. We then pretend that the actual odds are 3-2 and then we build in the EPM for those actual odds.

But, we only build them in for a bet on True. In this case, the modified pay-off odds become 2-1. The Placer is willing to bet on True at 2-1.

The Placer can also build a minimum EPM into a range bet. Recall that the range bet creates two straight bets. We add the minimum EPM to each just as we did with a single straight bet.

Thus the CSUB includes the following steps for enabling users to Place range bets with minimum profit margins built into the pay-off odds:

In Placing a Bet mode, inputs and stores the odds range from p1–p2, where p1<p2, inputs and stores the desired minimum EPM, creates two bets in the Placer's record with the same bet statement and stake such that the Placer has a minimum EPM for betting on True, given actual odds at p1, and a minimum EPM for betting on False, given actual odds at 1–p2, outputs the bet.

Some people might call an EPM and a minimum EPM a "margin of safety." The CSUB can enable people to build a margin of safety into the pay-off odds in the same way as an EPM. Though the math is identical, it is better to label these two things differently because the interpretation can be different. A person could, for example, build an EPM and a margin of safety into the pay-off odds.

Section 5. Linking Bets to Supported Statements

As discussed, the purpose of the invention is to provide a system that enables people to express probability estimates in the form of bets. Hence, a person can use the CSUB to place a bet that stands alone as a probability estimate.

Ordinarily though, when people give probability estimates, the conventional kind that is, the estimates are part of longer statements. For example, person might state reasons why it will probably rain and then say, "the chance of rain is 75% tonight." This estimate can stand alone or can be made part of the longer statement about why it will probably rain.

Bets too can be made part of ordinary statements. When a bet is made part of an ordinary statement, we will call that statement a Supported Statement (SS) because the bet is used to support some point or points made in the statement. And so, an SS is an ordinary statement that contains a bet—all of the bet, part of the bet, a summary of the bet, or a reference to the bet—that backs up some point made in the SS. We will call a supporting bet an "SB" for short.

An SS can be entered into the CSUB and stored along with the SB, or the SS can be entered and stored separately in its own record. We will assume, for simplicity's sake, that the SS is stored in its own record distinct from the SB.

As shown in the Search mode, the CSUB includes search means for finding SS's in the system data-base. The CSUB would also include means for modifying the SS.

While a conventional probability estimate is usually quite short, a bet (the bet statement part) can be short or long. Therefore, a bet can be longer or shorter than the SS it supports. For example, the SS can be a statement like, "It looks like rain tonight." The SB can be longer, defining what rain means, who will measure whether it has rained, and so on. On the other hand, the SS can be longer than the SB. The SS might be several pages about weather theory which may include a bet such as, "Based on the theory just explained, I'll bet $100, on True, at 4-1, that it will rain tonight."

An SS can be supported by multiple bets. For example, an SS about weather theory might include numerous facts and numerous predictions. Some or all of these assertions can be bet on.

An SS can include SB's made by anyone, not just the writer of the SS.

As mentioned above, an SS can contain all of an SB, part of an SB, a summary of an SB or reference to an SB. Vice versa, an SB record can contain all or part of the SS. The references can be two way. A reference to the SB in the SS might be in the text of the SS. Usually, the reference in the SB record would not be in the text of the bet statement.

More useful than simple references are active links between the SS and SB records. Means for linking bets to ordinary statements is a novel and very useful feature of the invention. Means for linking two records in a data-base are well known and need no elaboration here. For illustration's sake, we will discuss three basic types of links, though they are not meant to be exhaustive.

First, the SS can contain reference data that is linked to the SB record such that a user can open the SB record directly from the SS record, and vice versa. An example of this is having an icon appear in the display of the SS. By "clicking" on the icon, a user can open the SB record. Another example is a hypertext link, which allows the user to open the SB file directly from some word or phrase in the SS.

Second, the SS can contain data from the SB record such that when a change is made in the SB record, a corresponding change is made in the SS.

Third, if an SS has multiple SB's, a compilation file can be created where data from all the individual SB's are stored such that any change in an individual record causes a corresponding change to be made in the compilation file. We may call this file an SS-SB record.

A passage from a newspaper article is given as a small illustration of a few ways that an SS can actively reference SB's, The Labor Department reported yesterday that producer prices rose more in July than they have in 15 months (99.9, NA), rekindling the market's smoldering fears of inflation and heightening expectations that the Federal Reserve will raise interest rates next week . . .

Analysts said the report made higher interest rates more likely (55, Analyst) . . .

"What I think we are going to see is that U.S. economic growth will slow (Sohn-Z9), as a result of high interest rates and dampening demand in the current quarter," Sohn said.

(For full data on all bets, see SS-SB file: Glater, August 17).

In this passage we have put SB reference information in parentheses. In the first case, "(99.9, NA)" might signify that the reporter has placed a bet supporting his claim that the Labor Department statistic is correct. The 99.9 can signify that he has 99.9% confidence and has placed a bet to that effect, at those pay-off odds. The "NA" can signify that the bet has not been accepted.

In the second case, the reporter might be referencing a bet that a source has placed where the pay-off odds are set at 55%, signified here by "(55, Analyst)". The SB record could presumably be found under the article name and the name Analyst. Likewise, in the third case, we pretend that a source named Sohn has placed a bet that can be found under reference data Sohn-Z9. We do not however see any of the bet data, as in the two other cases. We pretend also that a compilation file is created that can be found under the reporter's name (Glater) and the date.

In all these cases, the SB's could be found by entering the reference data displayed. Further, any changes made in the individual SB records would cause a corresponding changes in the SS. For example, if the first bet was accepted, the NA might change to an A. Or if the pay-off odds on some bet changed, the corresponding figures, such as 55, could change. If a bet was settled, the result (True, False, or Undecided) could be given, and so forth.

Thus, as shown in drawing 11, the CSUB can include the following steps for enabling users to link bets with supported statements:

(For simplicity, we assume the SB has been entered first.)
- creates 130 a record for the SS,
- inputs and stores 131 the SS,
- inputs and stores 132 reference data for identifying a bet that supports the SS,
- checks the memory to see if a record exists for the supporting bet (SB),
  - if no, registers the absence of the SB,
  - if yes, links 133 the SB record and SS record such that,
    - a. the SB record can be opened by entering refererice data in the SS record,
    - b. the SS record can be opened by entering reference data in the SB record,
    - c. data from the SB record is copied into the SS record,
    - d. data in the SS record corresponding to data in the SB record changes when that data changes in the SB record,
- checks if there is more than one SB identified in the SS,
  - if yes, for each SB, repeats the steps above for linking the SS to the SB,
    - creates 134 a record for storing the multiple SB's,
    - stores 135 data from all the SB's entered for the SS, such that any change in the individual SB records is reflected in the corresponding data in the multiple SB record.

Section 6. Extra Features

The previous sections described a system that enables people to transact three types of bets and to link those bets to ordinary statements. However, it should be remembered that the system is a novel communications medium and as such it can include many more novel features than those described. This section will briefly describe some extra features that can be useful in a CSUB but the section is not comprehensive.

Counter Bets and Counter Statements

It is useful for a communications system to allow people to respond to the statements of others. Therefore, the CSUB can enable people to respond to the bets and supported statements of others. The system can enable people to make "counter-bets" and "counter-statements" which are responses to bets and supported statements that are already in the system data-base. A counter bet is the same as other bets but it is also labeled as a counter-bet and linked to the bet and/or SS that it is a response to. (As mentioned, techniques for linking two records need no elaboration.) The counter-statement is like an ordinary SS except that it is labeled as a counter-statement and is linked to the bet and/or SS it is a response to.

Guarantees

We have defined a bet as a certain type of agreement where a Placer and Acceptor both put something at risk. However, we can have a different type of agreement whereby the Placer puts up a stake, pledging that the bet statement is true. If the bet statement is false, the Placer pays the stake to the Acceptor. Such an agreement can be called a guarantee. The CSUB could enable users to transact guarantees in the same fashion as bets except no pay-off odds would be entered, the statement would be identified as a guarantee, and the Acceptor would not have anything at stake.

Note that bets can be set up that are virtually equivalent to guarantees. A Placer can make a bet with high pay-off odds where the Acceptor's stake is, say, one penny. The Placer's stake can be any amount, depending on the pay-off odds.

Entering a Probability Estimate Independent of the Pay-off Odds

In an actual odds bet the Placer strives in the pay-off odds to state what he thinks the actual odds are. At least the theory is that he usually does. With all other bets, the Placer's honest probability estimate is unknown. Moreover, the Acceptor's probability estimate is not known in any of the three bets described. Therefore, a useful feature of the invention is means for enabling users, both Placer's and Acceptor's, to enter an estimate of the actual probability that the statement is true.

This estimate has nothing to do with the pay-off odds but it can be very useful for compiling statistics in a user's record. The independent probability estimates can be subjected to various statistical tests to see how accurate the user's estimates were compared to the actual record of bet results. For example, all the estimates of a certain percentage can be put in a group. The results from the corresponding bets can be put in group and the two groups can be compared. For example, let us say a user has 10 bets where he has given an estimate of 50% true. The results in those bets could be anywhere from zero Trues to ten Trues. The system could then compare the estimates at a given probability to the actual results of corresponding bets.

Bet Statistics

The CSUB can apply various well known statistical tests to the data in a user's record. This data can include all the data entered for making individual bets, the results of the bets, as well as independent probability estimates and other information such as dates of the bets). The main idea is to see how well the user judges probability. These tests can thus be very useful for a key object of the invention is to show people how well users estimate probability.

Credibility Points

Credibility points (CP's) were mentioned in the preface as an alternative to betting money. The CSUB can enable users to make both cash bets and CP bets. It can include means for keeping track of both cash and CP credit/debit balances. It is useful to have both types of accounts in a public system where people's credibility is judged from results in bets.

Copying Bets

It can be very convenient for the CSUB to enable users to copy bets or copy parts of existing bets. If a user copies only part of a bet, the CSUB can also enable users to then add to the copied part to place a complete bet. In fact, means for copying bets are perhaps essential to a convenient CSUB. People may want to copy a bet or part of a bet for various reasons. For example, a person might want to copy all of a bet except for the side picked. In such a case, the person would be placing a bet on the opposite side of the bet that was originally placed. For another example, a person might want to respond to a bet by making minor modifications in the original. In a communications system, bets can be looked at as documents and as such, it is clear that it would be useful to be able to copy them or copy parts of them. Means for copying records and parts of records are well known and need no elaboration. Let us just note that the CSUB can include means enabling users to copy bets and part of bets and to modify those bets.

Non-public Bets

The CSUB can include means for enabling a user to make a non-public bet meaning that only the parties to the bet, or other designated people, can see the bet. Access to the bet record would be restricted by PIN. The main reason for this feature is that with certain bets public display can affect the outcome.

Targeting a Bet, Restricting Acceptors

The CSUB can include means for enabling a Placer to restrict who can accept a bet. The Placer would specify who can accept the bet and this information would be stored in the bet record. If someone else tried to accept the bet, the Placer could request that the acceptance be canceled. The system could also recognize an authorized Acceptor and reject any non-authorized Acceptor. This feature can be useful because often a bet will be issued as a challenge to some particular person or group. Also, a Placer might want to restrict the expertise of his potential opponents.

Confirmation Steps

It should go without saying, but we will mention it anyway, that the system can include confirmation steps where a user verifies the information he has entered.

Secondary Market

Once a bet is accepted, it can be valued by buyers and sellers based on the pay-off odds and the conditions the bet is about. A secondary market can be created then within the CSUB enabling users to buy and sell bets. This feature is very useful for it shows the changing perceptions users have of the pay-off odds. The prices for bets can be quoted both in cash (or points) and as changes in the odds. All transactions can be recorded in users' records.

Hedging

Selling a bet in a secondary market is one way a user can profit from a good bet or protect against loss in a bad bet. Another way is hedging, in which a bettor makes a bet statement that is identical to one made in a previous bet. The bettor then takes the opposite side of the bet than was taken in the original bet. The bettor may also change the original odds. Rather than placing a new bet, the user may also hedge by accepting the same bet but taking the opposite side from the side he originally took. Hedging is a well known and useful technique and thus the CSUB can include means for enabling users to automatically hedge a bet.

Lock-in Functions

As mentioned, it is useful to allow bettors to hedge their bets or sell their bets. That way the users can show that their opinions have changed and can allow users to realize profits or stem losses. On the other hand, when a user hedges a bet or sells a bet, the user's original expression of probability can lose force. The Placer shows himself not to be risking as much as in the original bet. Thus, the CSUB can include means for enabling a Placer or Acceptor to announce that he will not retract a bet, or will not sell the bet, or will not hedge the bet. Thus the user leaves himself more exposed but can give his bet more force as an expression of probability. The CSUB can include steps for specifying whether the bet is locked-in, and what kind of lock-in is specified: non-hedge, non-sale and/or non-retract. And, the system can include means for allowing other users to challenge a hedge or a sale or a retraction.

Infinite Variety of Bets

We have limited our discussion to probability based bets with pay-off odds, X–Y. However, there are many other types of useful bets, theoretically an infinite number. For example, a useful bet is what can be called a proximity bet. Two people can estimate a quantity, say the number of gumballs in a jar. The person who guesses closer wins. The pay-off rules can be quite varied for such a bet. The point is not to discuss this bet but to say that a CSUB can include many other types of bets. The applicant hopes to discuss some of these in a future application.

Betting versus the System by Random Number Generator

Another useful feature the CSUB can include is allowing user's to bet against the system using a random number generator. Here a user would make an actual odds bet and let the system pick the side by random number. The advantage of such a bet is that a person can bet without having anyone interested in a bet. Also, a person who fears he will be betting against more knowledgeable people can, of course, keep those opponents from betting against him. The drawbacks are several though, including that the system must appoint someone to monitor the bet. Nevertheless, in certain cases, such a bet can be useful.

The system could even include the feature of having a user bet against a random user where the side the random user takes is determined by random number generator.

I claim:

1. A communications apparatus for the transaction of bets over a network, said apparatus comprising in combination, a computer including input/output means, memory means, processing means, and program means, said apparatus holding a central data base and being connected to a network of input/output terminals, said program means directing the operation of said apparatus, said program means directing said apparatus to enable users to choose from among several modes for entering information into said central data base, including:

a user account mode for enabling a user to establish a user account in said data base, a search mode for enabling a user to search said data base, a placing a bet mode for enabling a first user to enter a bet into said data base, an accepting a bet mode for enabling a second user to accept said bet, a changing a bet mode for enabling either of said users to change said bet and, a settling a bet mode for enabling said users to settle said bet;

when a user chooses said user account mode, said program means directing said apparatus to execute the steps of:

creating a user record for identification data, contact data, billing data, credit/debit data, bet data, and bet result data, creating a user identification number (PIN) and storing it in said user record, outputting said PIN to said user, inputting and storing said user's name, contact, billing, and credit/debit data in said user record;

when a user chooses said search mode, said program means directing said apparatus to execute the steps of:

inputting search parameters for a bet, checking to see if a bet matching said parameters is in said data base, if said bet is not found, outputting a message saying that no such bet is found, if said bet is found, outputting the bet;

when a user chooses said place a bet mode, said program means directing said apparatus to execute the steps of:

creating a record for storing data for a bet, storing said user's PIN in said bet record and identifying said user by the name of Placer, inputting and storing in said record a bet statement, inputting and storing in said record the type of commodity being bet, inputting and storing in said record the amount at stake, and identifying said amount as said user's stake, inputting and storing in said record the payoff odds, if the odds are in X–Y form, converting them to percentage form, storing them, in said record, in percentage form as well, if the payoff odds are in percentage form, converting them to X–Y form, storing them, in said record, in X–Y form as well, inputting and storing in said record the side of the bet ("True" or "False") that said user is taking, assigning the opposite side of the bet to a not yet identified, dummy user called by the name of Acceptor, calculating and storing in said record an amount needed to cover said Placer's stake, and identifying said amount as the Acceptor's stake, outputting the information stored in said bet record;

when a second user chooses said accept a bet mode, said program means directing said apparatus to execute the steps of:

inputting search parameters for a bet, finding said bet, checking to see if said bet has already been accepted, if yes, outputting a message, "bet has already been accepted,"

if no, storing said second user's PIN in said bet record and identifying said second user by the name of Acceptor, and identifying said Acceptor's stake as said second user's stake, and further, storing an acceptance in said bet record, and alerting said Placer of the acceptance, immediately after storing said acceptance, starting a clock with a pre-set time limit, when the time on the clock expires, checking to see if either Placer or Acceptor has canceled the acceptance, if yes, doing nothing to said bet record, if no, storing a confirmation of said acceptance in said bet record;

when a user chooses said change a bet mode, said program means directing said apparatus to execute the steps of:

inputting search parameters for a bet, finding said bet, verifying that said user is the Placer or Acceptor of said bet, checking if said bet has been accepted, if the bet has not been accepted, receiving an input from the Placer, checking if said input is to cancel or change the bet, if said input is to cancel the bet, canceling the bet, storing said cancellation in said user's record, if input is to change the bet, inputting and storing changes in said bet record, if said bet has been accepted, checking whether said acceptance is confirmed, if yes, outputting a message, "No changes allowed now,"

if no, checking whether said user is the Placer or Acceptor, if said user is the Placer, canceling the bet, storing the cancellation in said user's record, alerting the Acceptor of said cancellation, if said user is the Acceptor, canceling the acceptance, storing the cancellation in said user's record, alerting the Placer of said cancellation;

when a user chooses said settle a bet mode, said program means directing said apparatus to execute the steps of:

inputting search parameters for a bet, finding said bet, checking said user's PIN to see if said user is either the Placer or Acceptor, if no, outputting a message, "You are not authorized to report a result,"

if yes, receiving an input for a judge or a bet result, if said input is a call for a judge, sending a message to a system judge, if said input is a bet result, storing the result in said bet record as the result of said user, checking to see if results have been entered by both Placer and Acceptor, if no, alerting the other user identified in said bet record of said result, if yes, checking to see if results match, if the results do not match, alerting Placer and Acceptor of the clashing results, if the results match, storing the matching result in the bet and users' records, alerting the Placer and Acceptor that bet is settled, if the matching result is "Undecided," declaring neither Placer nor Acceptor the winner, if the matching result is "True," identifying the user assigned the side of "True" as the winner and the user assigned "False" as the loser, if the matching result is "False," identifying the user assigned the side of "False" as the winner and user assigned "True" as the loser, crediting the winner's account by the loser's stake and debiting the loser's account by the loser's stake.

2. The communications apparatus of claim 1 wherein:

said program means also directs said apparatus to enable users choose a supported statement mode for enabling said users to enter a text statement, called a supported statement, into said data base;

when a user chooses said supported statement mode, said program means directing said apparatus to execute the steps of:

creating a record for a supported statement (SS), inputting and storing an SS in said record, inputting and storing reference data that refers to a bet, identified as a supporting bet (SB), and that refers to the record for said SB, linking said SB record and SS record such that the apparatus executes the steps of:

a. opening said SB record when a user enters reference data in said SS record that refers to said SB record, b. opening said SS record when a user enters reference data in said SB record that refers to said SS record, c. copying selected data from said SB record into said SS record.

* * * * *